US012728961B2

(12) United States Patent
Beese et al.

(10) Patent No.: US 12,728,961 B2
(45) Date of Patent: Sep. 8, 2026

(54) ADJUSTABLE DEPTH DATA BUOY

(71) Applicant: IN-SITU, INC., Fort Collins, CO (US)

(72) Inventors: Aaron Beese, Fort Collins, CO (US); Michael Burns, Fort Collins, CO (US)

(73) Assignee: IN-SITU, INC., Fort Collins, CO (US)

( * ) Notice: Subject to any disclaimer, the term of this patent is extended or adjusted under 35 U.S.C. 154(b) by 322 days.

(21) Appl. No.: 18/625,110

(22) Filed: Apr. 2, 2024

(65) Prior Publication Data

US 2025/0304217 A1 Oct. 2, 2025

(51) Int. Cl.
*B63B 22/18* (2006.01)
*B63B 79/15* (2020.01)

(52) U.S. Cl.
CPC ..... *B63B 22/18* (2013.01); *B63B 79/15* (2020.01); *B63B 2213/02* (2013.01)

(58) Field of Classification Search
CPC ..... B63B 22/18; B63B 79/15; B63B 2213/02; B63B 2022/006; B63B 22/00
See application file for complete search history.

(56) References Cited

U.S. PATENT DOCUMENTS

| | | | |
|---|---|---|---|
| 4,461,172 | A | 7/1984 | McKee et al. |
| 4,682,156 | A | 7/1987 | Wainwright |
| 4,712,505 | A | 12/1987 | Wainwright |
| 4,843,325 | A | 6/1989 | McKee, Jr. |
| 5,337,601 | A | 8/1994 | Becker et al. |
| 6,798,347 | B2 | 9/2004 | Henry et al. |
| 8,593,905 | B2 | 11/2013 | Gagliardi et al. |
| D755,655 | S | 5/2016 | Scott et al. |
| 9,689,855 | B2 | 6/2017 | Scott et al. |
| 9,778,180 | B2 | 10/2017 | Baltz et al. |
| D803,081 | S | 11/2017 | Scott et al. |
| 9,835,554 | B2 | 12/2017 | Scott et al. |

(Continued)

FOREIGN PATENT DOCUMENTS

| | | |
|---|---|---|
| CN | 201689088 U | 12/2010 |
| CN | 202175170 | 3/2012 |

(Continued)

OTHER PUBLICATIONS

Bandyopadhyay et al. (1989) "Instrumentation for continuous in situ monitoring of water quality," IEEE Transactions on Instrumentation and Measurement 38:3.

(Continued)

*Primary Examiner* — Sheetal R Paulson
(74) *Attorney, Agent, or Firm* — Leydig, Voit & Mayer, Ltd.

(57) ABSTRACT

Provided herein are buoys comprising a floatable support having an upper surface and a lower surface, the upper surface formed from a plurality of outer faces and a central orifice, wherein at least one outer face has a surface shape that is flat to prevent rolling of the floatable support around a longitudinal axis of the floatable support; an outer tube connected to the floatable support that is positioned in the central orifice having: an upper portion extending past the upper surface, and a lower portion extending past the lower surface; and an inner tube telescopingly connected to the outer tube so that a depth of a lower end of the inner tube relative to the floatable support is controllably adjustable, (Continued)

wherein the inner tube comprises a depth-adjustable instrument receiving volume configured to protectably receive a water quality instrument.

26 Claims, 23 Drawing Sheets

(56) References Cited

U.S. PATENT DOCUMENTS

| | | | |
|---|---|---|---|
| 10,365,097 | B2 | 7/2019 | Steinbach et al. |
| 10,429,369 | B2 | 10/2019 | McKee |
| 10,704,893 | B2 | 7/2020 | Sun |
| 11,181,427 | B2 | 11/2021 | Kimbell et al. |
| 11,618,870 | B2 | 4/2023 | Angelescu et al. |
| 2008/0141797 | A1 | 6/2008 | Rodriguez et al. |
| 2020/0240878 | A1 | 7/2020 | Trumbo et al. |
| 2021/0199577 | A1 | 7/2021 | Scott et al. |

FOREIGN PATENT DOCUMENTS

| | | | |
|---|---|---|---|
| CN | 203601529 | U | 5/2014 |
| CN | 111896703 | A | 11/2020 |
| CN | 111216847 | B | 1/2021 |

OTHER PUBLICATIONS

Ethier et al. (2007) "Development of a Real-Time Water Quality Buoy for the Fraser River Estuary," Oceans, Vancouver, BC, Canada, 2007, pp. 1-6, doi: 10.1109/OCEANS.2007.4449424.

In-Situ "Rugged Buoy" Operator's Manual (Nov. 21, 2023) available at In-situ.com/us/rugged-buoy.

In-Situ "Rugged Buoy" (Nov. 21, 2023) available at: in-situ.com/us/rugged-buoy.

Medina et al. (Jun. 2022) "Open-source low-cost design of a buoy for remote water quality monitoring in fish farming," PLOS One 17(6): e0270202. https://doi.org/10.1371/journal.pone.0270202.

Quevy et al. (Jan. 2023) "Open Sensing System for Long Term, Low Cost Water Quality Monitoring," IEEE Open Journal of the Industrial Electronics Society, vol. 4, pp. 27-41, doi: 10.1109/OJIES.2022.3233919.

Schmidt et al. (2018) "Design and operation of a low-cost and compact autonomous buoy system for use in coastal aquaculture and water quality monitoring," Aquacultural Engineering, 80, pp. 28-36.

Tian et al. (2020) "A Floating Optical Buoy (FOBY) for Direct Measurement of Water-Leaving Radiance Based on the Skylight-Block Approach (SBA)," Journal of Geophysical Research: Oceans, 125, e2020JC016322. https:// doi.org/10.1029/2020JC016322.

U.S. Appl. No. 29/941,025, filed May 7, 2024.

ADJUSTABLE DEPTH DATA BUOY

BACKGROUND OF THE INVENTION

Provided herein are buoys configured for long-term deployment of instruments and telemetry in bodies of water having a number of functional advantages over conventional buoys.

Conventional buoys tend to have fixed length tubes that, while protecting an instrument placed therein, are not depth adjustable. In contrast, conventional buoys that are depth adjustable tend to have the instrument connected to the buoy in a manner that the buoy does not protect the instrument. For example, the instrument may be placed in a cage where the instrument depth is set by selecting where on the buoy the cage is connected. That configuration, however, does not reliably protect the instrument within an interior volume of the buoy. In view of these limitations, there is a need for a buoy having a fully protected instrument area confined within a buoy interior volume that is reliably depth adjustable so that the instrument may be deployed with a range of depths from the water surface in which the buoy floats.

Some buoys provide fixed depth within a protective tube. Others provide depth "adjustment" by selectively mounting to an open/unprotected cage, but this depth setting is not easily repeatable after removal for maintenance/calibration. There is a need for full instrument/telemetry protection while offering depth adjustment and highly repeatable depth setting by having appropriate components, so that the devices can inside the inner tube. Buoys in the art may be of low price and lower quality (plastic/rubber construction) or of high price (stainless steel with integrated solar or telemetry). An issue with the stainless steel is that while mechanically robust, they tend to eventually rust in a marine environment. Plastic, while corrosion-proof, is UV-susceptible and far less strong.

Furthermore, conventional buoys tend to have a rotationally symmetric geometry, resulting in a tendency to roll on a dock or boat resting surface. This can be a problem with uncontrolled rolling having a potential for injury, damage (to the instrument or an environment around the instrument), safety and even unwanted rolling into the body of water. In addition, many buoys in the art are simply too heavy for a single person to carry/deploy, and their shipment requires using freight carriers or paying substantial oversize fees.

Provided herein are buoys that address the above problems through the use of specially configured components that protect instruments while being fully depth adjustable, in a safe, reliable and efficient manner.

SUMMARY OF THE INVENTION

The problem of fully protecting a water quality instrument while providing an adjustable depth of the water quality instrument is addressed herein by use of a specially configured outer tube and inner tube that relies on their telescoping connection and passages through the inner tube to provide an adjustable depth of the water quality instrument while fully protecting the water quality instrument. The tubes may be formed from aluminum tubes that are corrosion-resistant and UV stable in a marine environment, while being far more affordable than stainless steel and substantially stronger than plastic. Use of an elastomeric disk inside the inner tube may facilitate full instrument/telemetry protection while offering depth adjustment and highly repeatable depth setting by resting the instrument upon the elastomeric disk. Having specially shaped surface ensures the buoy resists rolling. These aspects are achieved all while providing a buoy that is characterized herein as compact and lightweight in that the domestic and international shipment is compatible with standard shipment fees (no oversize charges) and can be handled by an individual.

The buoys provided herein can ship domestically and internationally using standard carries and do not incur oversize charges. This is achieved by the specially-configured inner and outer tube that telescopingly connect in such a manner that the instruments are protected within the tubes, but in a configuration that is depth-adjustable. For example, the buoy may comprise a depth-adjustable instrument receiving volume. The depth-adjustable instrument receiving volume is configured to protectably receive a water quality instrument. This provides protection to the water quality instrument from environmental and other damage while facilitating ease of depth adjustment, including ranging from a minimum to maximum depth, such as selected from a range of 0.2 m to 1.5 m, including between 0.3 m to 1 m depth from the water surface.

In some embodiments, the bottom surface of the depth-adjustable instrument receiving volume is formed by an instrument support layer, such as an elastomeric disk, a rubber membrane, and the like. The elastomeric disk allows the water quality instrument to rest upon it without harming or damaging the water quality instrument. This allows a user to reproducibly set the end of the water quality instrument to given a given depth (i.e., the depth of the elastomeric disk) without damaging the water quality instrument.

In some embodiments, the invention comprises a plurality of inner tube passages that traverse the inner tube. These passages provide an exchange of water between the depth-adjustable instrument receiving volume and the surrounding water environment. This exchange provides a good water refresh to the water quality instrument, improving the accuracy of the measurements of the water quality instrument.

In some embodiments, the invention comprises an inner tube telescopingly connected to the outer tube and the outer tube comprises a safety stop. The safety stop provides a safety separation distance between the lower end of the inner tube and a lower end of the outer tube. Therefore, the safety stop also protects against the plurality of inner tube passages from being covered during telescoping.

The upper surface of the floatable support may be formed from a plurality of outer faces, with at least one outer face having a surface shape configured so that the buoy resists rolling while place on a or leaning against a surface. For example, the outer face may have a surface shape that is at least partially flat.

Provided herein are buoys comprising a floatable support having an upper surface and a lower surface, the upper surface formed from a plurality of outer faces and a central orifice, wherein at least one outer face has a surface shape to prevent rolling of the floatable support around a longitudinal axis of the floatable support. The surface shape may be flat so that the outer face rests on a flat surface. The surface shape may have regions that form a contact plane that prevents rolling, such as line(s) that define a concave region, with the line(s) that prevent rolling over a surface, and the concave region relative to the line(s) that may not actually contact the surface. An outer tube may be connected to the floatable support, such that a part of the outer tube is positioned in the central orifice. The outer tube further has an upper portion (which has an upper end) extending past the floatable support upper surface, and a lower portion extending past the floatable support lower surface. An inner tube telescopingly connects to the outer tube so that a depth of a lower end of the inner tube relative to the floatable support and, thereby, a water surface during use, is controllably adjustable. In this manner, the inner tube comprises a depth-adjustable instrument receiving volume configured to protectably receive a water quality instrument so that the instrument can be provided at a user-selectable depth relative to a water surface. An inner tube can be telescopingly connected to the outer tube so that a depth of a lower end of the inner tube relative to the floatable support, and thereby a water surface during water deployment, is controllably adjustable. The inner tube thereby comprises a depth-adjustable instrument receiving volume configured to protectably receive a water quality instrument.

A cap having a top surface positioned above the outer tube upper portion and separated from the outer tube upper portion by a telemetry communication separation distance is controllably connected to an upper end of the outer tube. The cap can be configured to operably connect to a marine beacon and operably connect to a telemetry device. The marine beacon is useful for providing an optical signal of the buoy location and avoid inadvertent contact with boaters and other water surface users. The telemetry device operably connected to the cap has at least a portion of a communication component of the telemetry device that is positioned outside the outer tube upper portion. In this manner, there may be a wireless connection between the buoy and a data receiving unit, including to record buoy position, instrument functionality, and/or measured water parameters from the instrument. For embodiments where the buoy position is desirably fixed or constrained, an optional fastener connected to the buoy is configured to connect to a mooring line for reliable positioning of the buoy during use. The fastener may be connected at any location that does not adversely impact buoy (and instrument) function, such as at the lower end of the inner tube and/or the lower portion of the outer tube. Of course, for embodiments where fixed or constrained buoy position is not required, the fastener may be omitted or not used.

To facilitate buoy handling and positioning, the buoy may further comprise a floatable strap coupled to the floatable support or the outer tube. The floatable strap is useful for handling, positioning, deployment and/or retrieval of the buoy. The floatable strap may be reversibly connected, and can be removed once the buoy is deployed and reconnected if the buoy is to be removed from the water and/or relocated. The floatable nature avoids the strap sinking if inadvertently dropped.

In some embodiments, the fastener comprises a set of chains. In some embodiments, the fastener may comprise any suitable fastener, including chains, ropes, threads, bolts, nails, screws, nuts, keys, washers, rivets, anchors, studs, inserts, rings, pins, grommets, clips, latches, and sockets.

In some embodiments, the communication component of the telemetry device comprises an antenna. In some embodiments, the antenna comprises: a cellular antenna, a GPS antenna, or a cellular and a GPS antenna. It is preferable for the antenna, or at least a portion thereof, to be positioned outside of the outer tube to ensure more reliably communication with a remote location.

In some embodiments, the floatable support has a floatable support shape that is a toroidal shape. In some embodiments, the floatable support shape may be any shape that is suitable for supporting the other elements of the buoy, including cylindrical, spherical, spheroidal, conical, hemispherical, pyramidal, frustoconical, ovoidal, cubic, a bicone, or a tapered cylinder. Preferably, the toroidal shape has a flat lower surface with a top surface having a plurality of outer faces configured to prevent unwanted rolling over a surface.

In some embodiments, the floatable support provides at least 90 pounds of a buoyant force. In some embodiments, the floatable support may provide at least 80 pounds, at least 70 pounds, at least 60 pounds, or at least 50 pounds of buoyant force. In some embodiments, the floatable support may provide up to 100 pounds, at least 110 pounds, at least 125 pounds, at least 150 pounds, or at least 200 pounds of buoyant force. For example, the provided buoyant force may correspond to a maximum buoyant force of between 50 pounds and 200 pounds, and any sub-ranges thereof. In this manner, depending on the application of interest, including the total mass of instruments to be supported or contained in the buoy, a compatible floatable support is selected. For example, for larger desired buoyant forces, a larger floatable support may be utilized, including having larger dimensions, less dense material, different shell composition and/or foam-filler composition, and the like. As can be appreciated, the floatable support is preferably configured so that during buoy deployment, a portion of the buoy floats on the water surface.

In some embodiments, the floatable support comprises a foam interior. For example, the floatable support may have a shell surface with a foam-filled interior. In some embodiments, the floatable support comprises polyethylene and/or polyurethane, including a shell former thereof.

In some embodiments, the outer tube and the inner tube comprises aluminum. In some embodiments, the inner tube and/or the outer tube comprises aluminum, including 6061 aluminum. In some embodiments, the inner tube comprises steel, stainless steel, other metals, polyvinyl chloride, or other plastics.

In some embodiments, the outer tube further comprises a safety stop configured to provide a safety separation distance between the lower end of the inner tube and a lower portion of the outer tube.

The outer tube may connect to the floatable support upper surface at a lip that circumferentially extends around the perimeter of the outer tube. This provides an increase in contact area and additional robustness to the floatable support connection to the outer tube.

In some embodiments, the buoy further comprises a plurality of inner tube passages that traverse the inner tube, the plurality of inner tube passages configured to provide an exchange of water between the depth-adjustable instrument receiving volume and a surrounding water environment. In some embodiments, the buoy comprises at least two, at least three, at least four, at least five, at least ten, or at least twenty passages that traverse the inner tube.

In some embodiments, the buoy further comprises a lock between the cap and the upper portion of the outer tube to lockably connect the cap to the outer tube in a locked and an unlocked configuration. In some embodiments, the lock may comprise a tie wire.

In some embodiments, the buoy further comprises a mount connected to the cap to operably connect the cap to the telemetry device, wherein for the cap connected to the upper end of the outer tube the telemetry device is positioned within a volume formed by the upper portion of the outer tube and the cap.

In some embodiments, the communication component of the telemetry device that is positioned outside the outer tube upper portion is attached to an inner surface of the cap.

In some embodiments, the marine beacon is attached to an outer surface of the cap.

In some embodiments, the water quality instrument is selected from the group consisting of: a temperature sensor; a pH sensor; a dissolved oxygen sensor; an actual conductivity sensor; a specific conductivity sensor; a salinity sensor; a total dissolved solids sensor; a resistivity sensor; a density sensor; an oxidation reduction potential sensor; a water level sensor; and a water pressure sensor.

In some embodiments, the buoy further comprises an instrument support layer connected to a bottom inner surface of the inner tube to form a bottom surface of the depth-adjustable instrument receiving volume. The instrument layer may comprise an elastomeric disk.

In some embodiments, the buoy further comprises a plurality of passages that traverse the instrument support layer configured to provide free flow of water between the depth-adjustable instrument receiving volume and a surrounding water environment. Of course, the passages may also be positioned elsewhere, including through a bottom portion of the inner tube.

In some embodiments, the lower end of the inner tube relative to the floatable support is controllably adjustable so that the lower end of the inner tube is at a depth selected from the range of 1 foot to 3 feet below a surface of a body of water.

In some embodiments, the buoy has a weight of less than 40 pounds. In some embodiments, the buoy has a weight of less than 30, less than 20, or less than 10 pounds. In some embodiments, the buoy has a weight up to 50, less than 75, or less than 100 pounds. In some embodiments, the buoy has a weight selected from the range of 10 pounds to 100 pounds, such as between 25 pounds and 45 pounds, with a net buoyancy of between 50 pounds and 100 pounds, including about 20 kg to 40 kg.

The particular positions of the inner and outer tubes with respect to each other is of less importance than the ability to provide reliable depth adjustment via the telescoping connection. A first tube is directly mounted to the float, and the second tube supports the water quality instrument and can move relative to the first tube, such that the position of the water quality instrument relative to the float (and therefore the water) is user-selectable. In an embodiment, the first tube is characterized as an outer tube and the second tube an inner tube, thereby providing a telescoping configuration.

In some embodiments, a method of deploying a water quality instrument to measure a water parameter comprises the steps of: providing any of the buoys described herein and inserting a water quality instrument into the depth-adjustable instrument receiving volume. telescopingly adjusting the depth of the lower end of the inner tube to provide a user-selected instrument depth; securing the cap to the outer tube upper end; and connecting the fastener to the mooring line; thereby deploying the water quality instrument to measure the water parameter.

In some embodiments, the step of inserting comprises: opening the upper portion of the outer tube to the water quality instrument by removing the cap from the upper portion of the outer tube; and positioning the water quality instrument into the upper portion of the outer tube, and wherein the step of securing comprises: locking the cap so that the cap cannot be removed from the upper end of the outer tube.

In some embodiments, the water quality instrument has a lower surface that rests on an elastomeric disk connected to the bottom surface of the inner tube at a deployed depth position. In some embodiments, the elastomeric disk comprises rubber. In some embodiments, the elastomeric disk comprises an unsaturated rubber or a saturated rubber. In some embodiments, the elastomeric disk comprises a natural polyisoprene, a synthetic polyisopropene, polybutadiene, chloroprene rubber, polychloroprene, neoprene, a butyl rubber, a halogenated butyl rubber, a styrene-butadiene rubber, a nitrile rubber, or a hydrogenated nitrile rubber. In some embodiments, the elastomeric disk comprises ethylene propylene rubber (EPM), ethylene propylene diene rubber (EPDM), epichlorohydrin rubber (ECO), an acrylic rubber, a silicone rubber, a fluorosilicone rubber, a fluoroelastomer, a perfluoroelastomer, a polyether block amide, chlorosulfonated polyethylene (CSM), or ethylene-vinyl acetate (EVA). In some embodiments, the elastomeric disk comprises a thermoplastic elastomer, resilin, elastin, a polysulfide rubber, elastolefin, or poly(dichlorophosphazene).

In some embodiment, the telescopingly adjusting the depth step provides the deployed depth position that is greater than or equal to 1 foot and less than or equal to 3 feet below a water surface.

The buoys described herein may be characterized as being compact and able to ship via conventional shipping rates without excess size charges. In this aspect, compact refers to the configuration of the inner and outer tubes that have a minimum length corresponding to a maximum stored configuration where the inner tube and outer tube telescope connection provides a minimum total length that is less than or equal 40 inches, such as 39.6 inches, with a maximum floatable support diameter that is less than or equal to 25", such as 20". The telescopingly connection between the tubes provides the ability to generate a maximum length, including, but not limited to, between 60" to 75", such as 65.6".

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWING(S)

Figure 11:
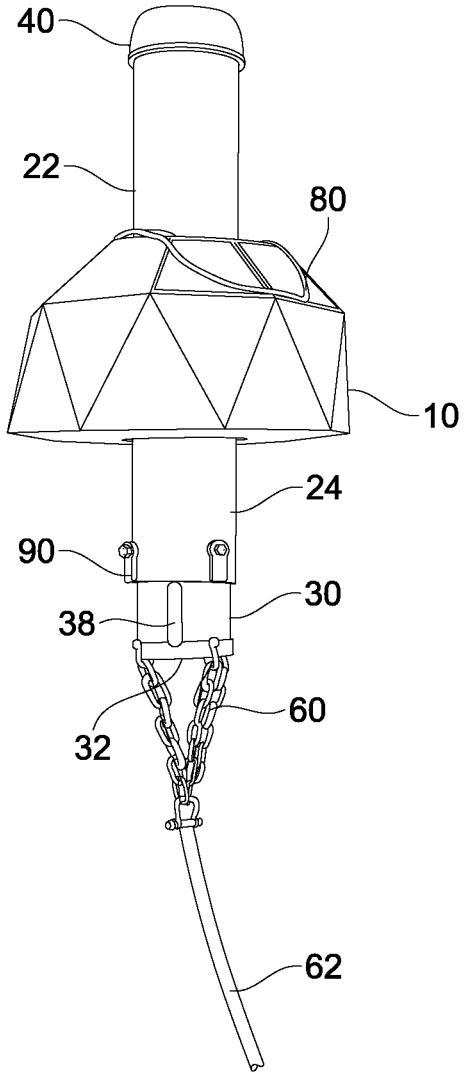

FIG. 11 is an image of a deployed buoy according to some embodiments. The inner tube is shown in a retracted position. The buoy is illustrated as held in place via the fastener connected to a mooring line.

Figure 12:
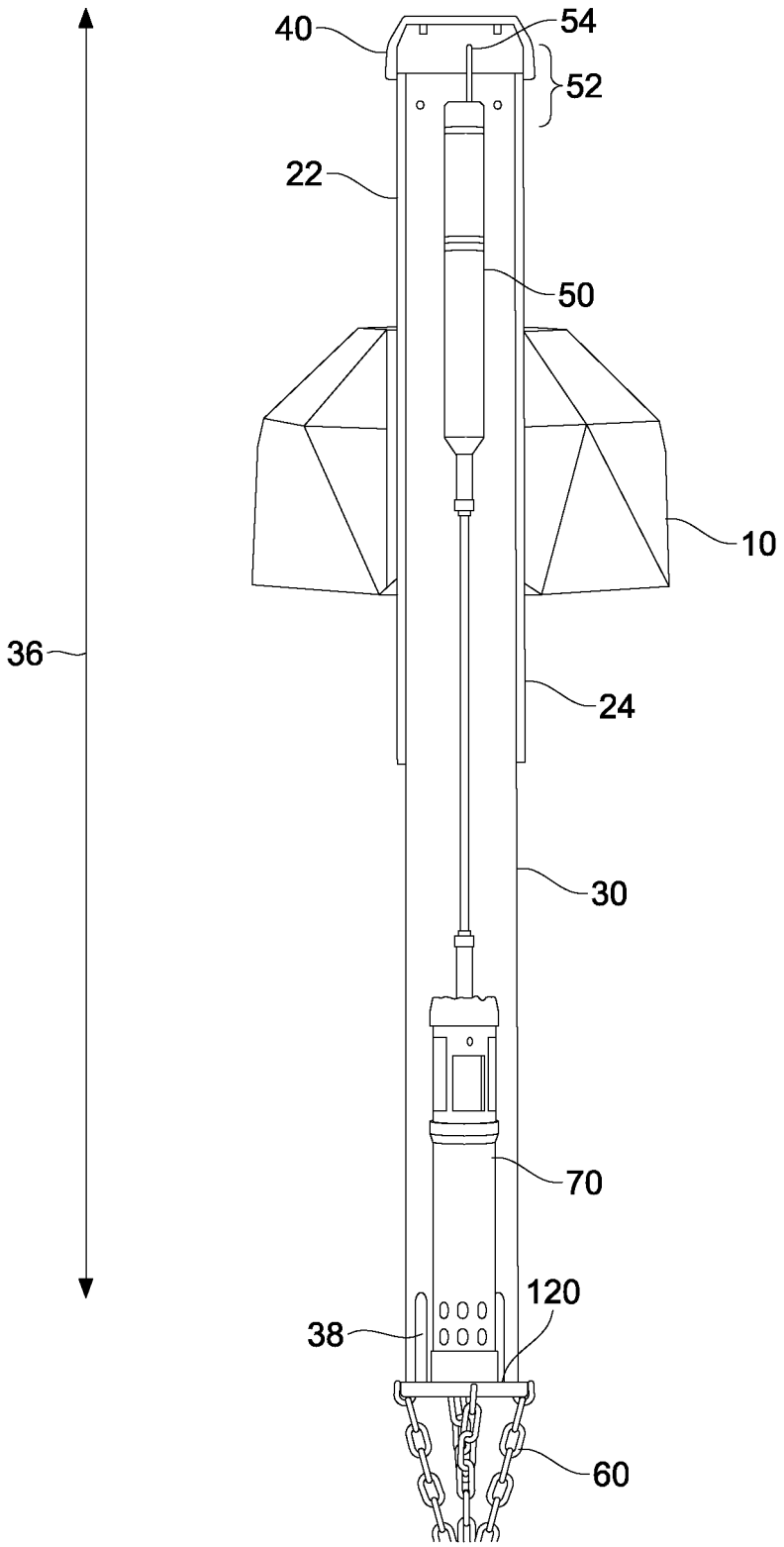

FIG. 12 is a cut-away side view of a buoy according to some embodiments. A telemetry device and a water quality instrument are shown within the buoy.

Figure 13:
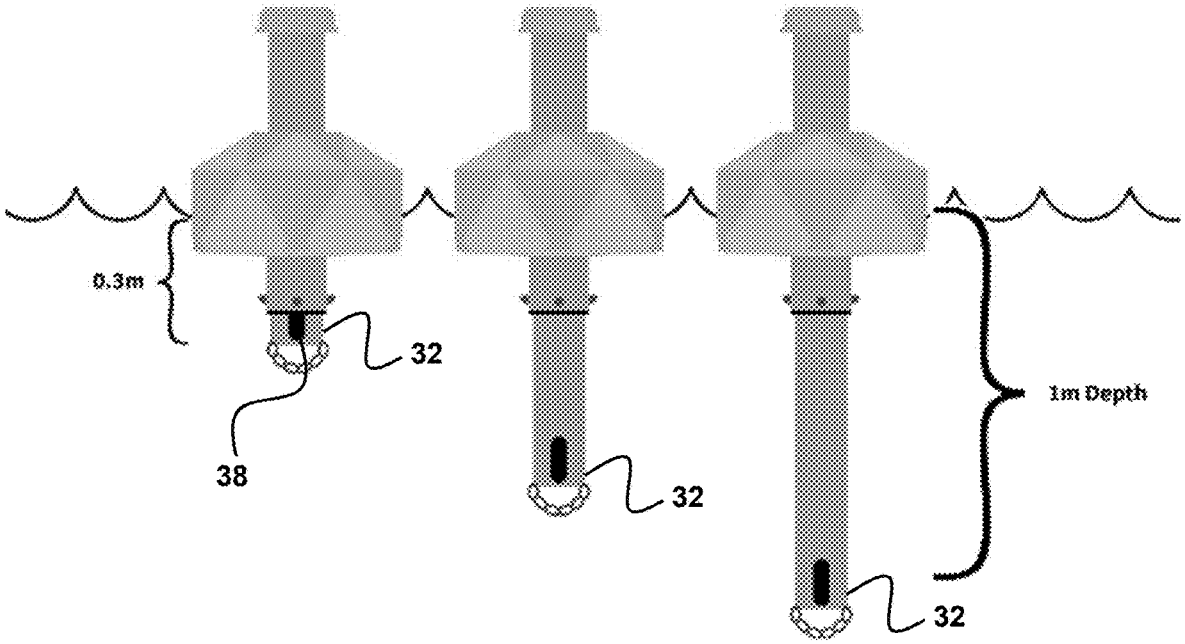

FIG. 13 is a side-view illustration of a series of buoys, according to some embodiments, highlighting how varying the position of the inner tube changes the depth of the inner tube lower end with respect to the surface of the water, thereby providing a depth-adjustable and controllable instrument positioned within the buoy.

Figure 14:
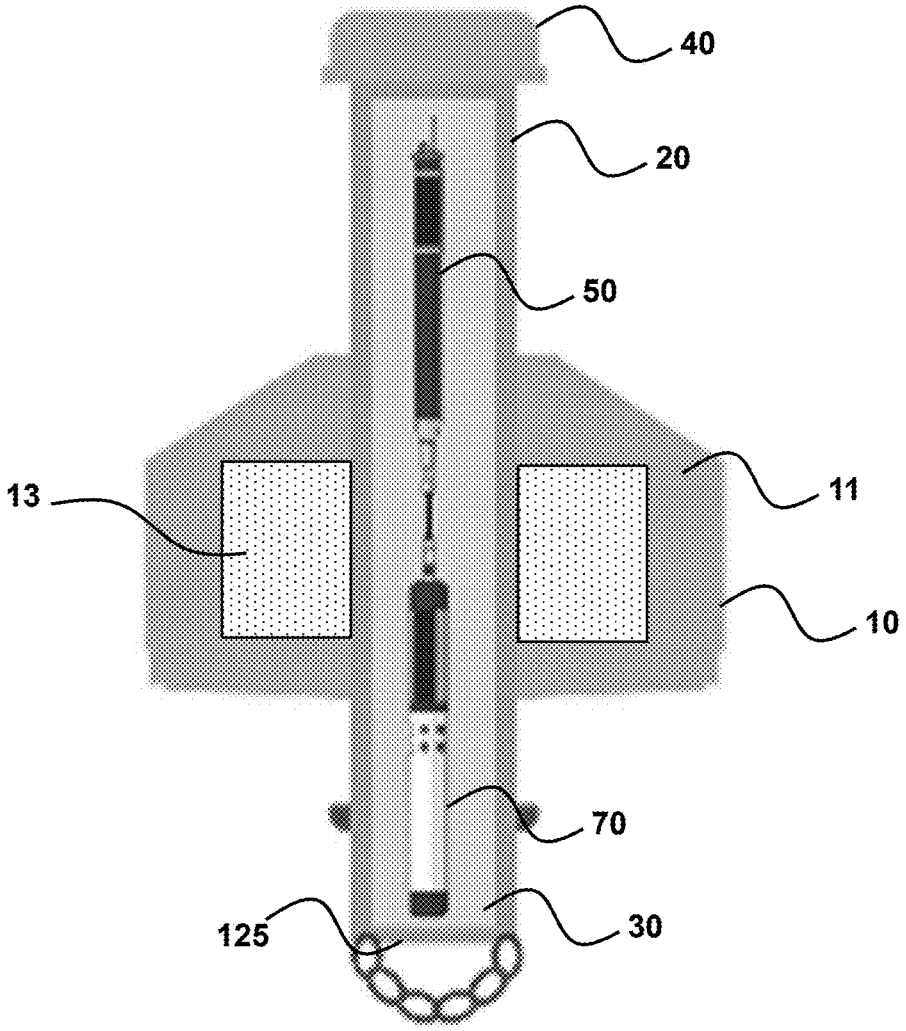

FIG. 14 is an illustrated cut away side view of a buoy, according to some embodiments, showing the relative position of the telemetry device and the water quality instrument within the buoy.

Figure 15:
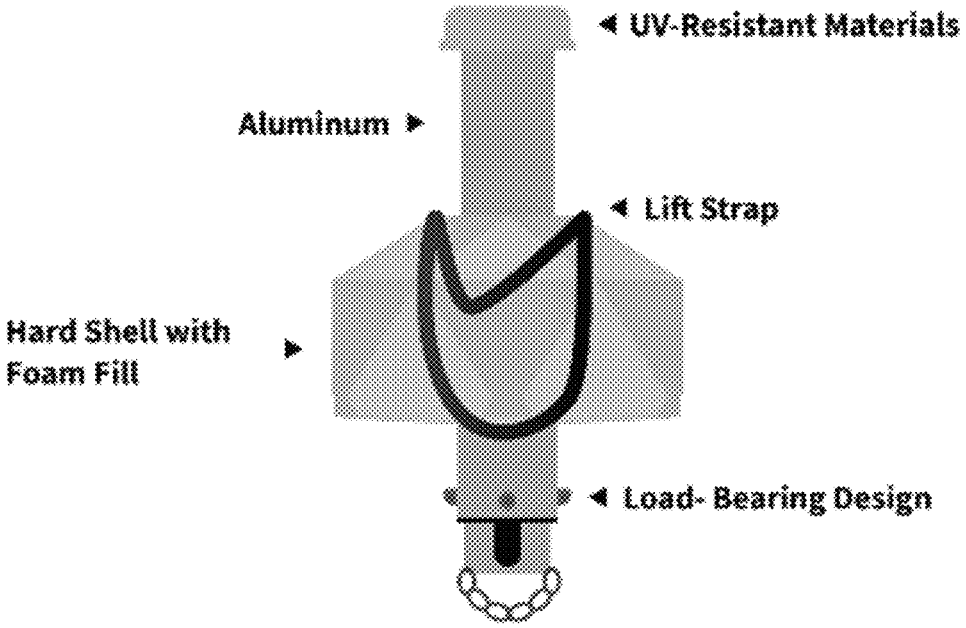

FIG. 15 is an illustrated side view of a buoy according to some embodiments.

Figure 16:
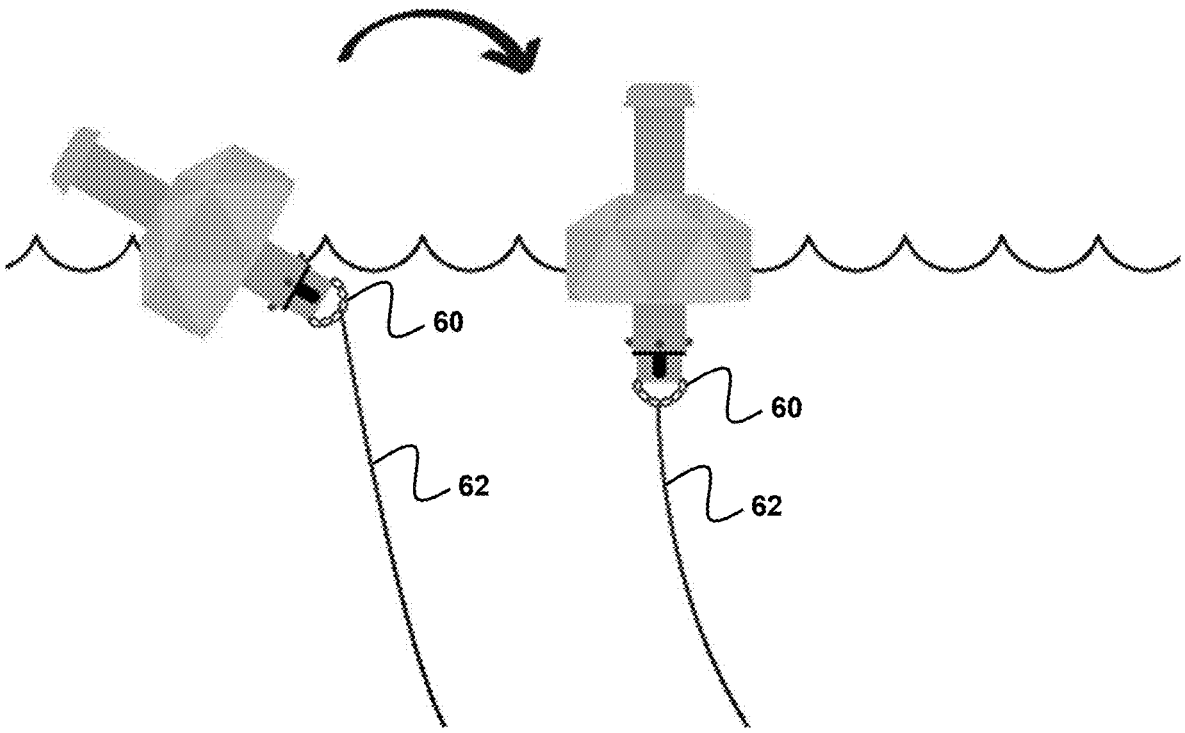

FIG. 16 is a side-view illustration of a series of buoys, according to some embodiments, highlighting how the buoy maintains itself upright, including with a fastener connected to a mooring line.

Figure 17:
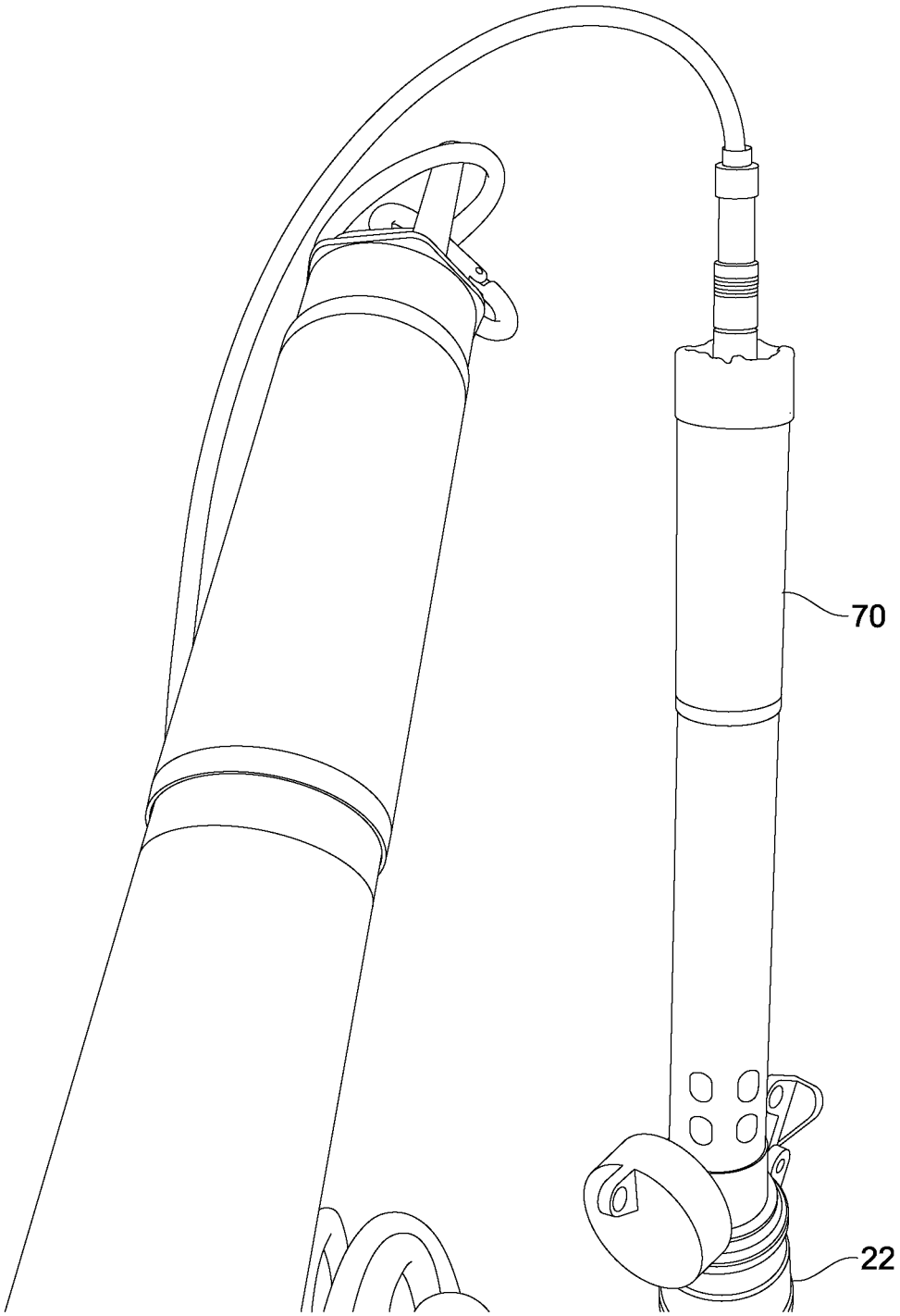

FIG. 17 is an image of a water quality instrument being inserted into a buoy, according to some embodiments, through the upper portion of the outer tube with the cap in an open position.

Figure 18:
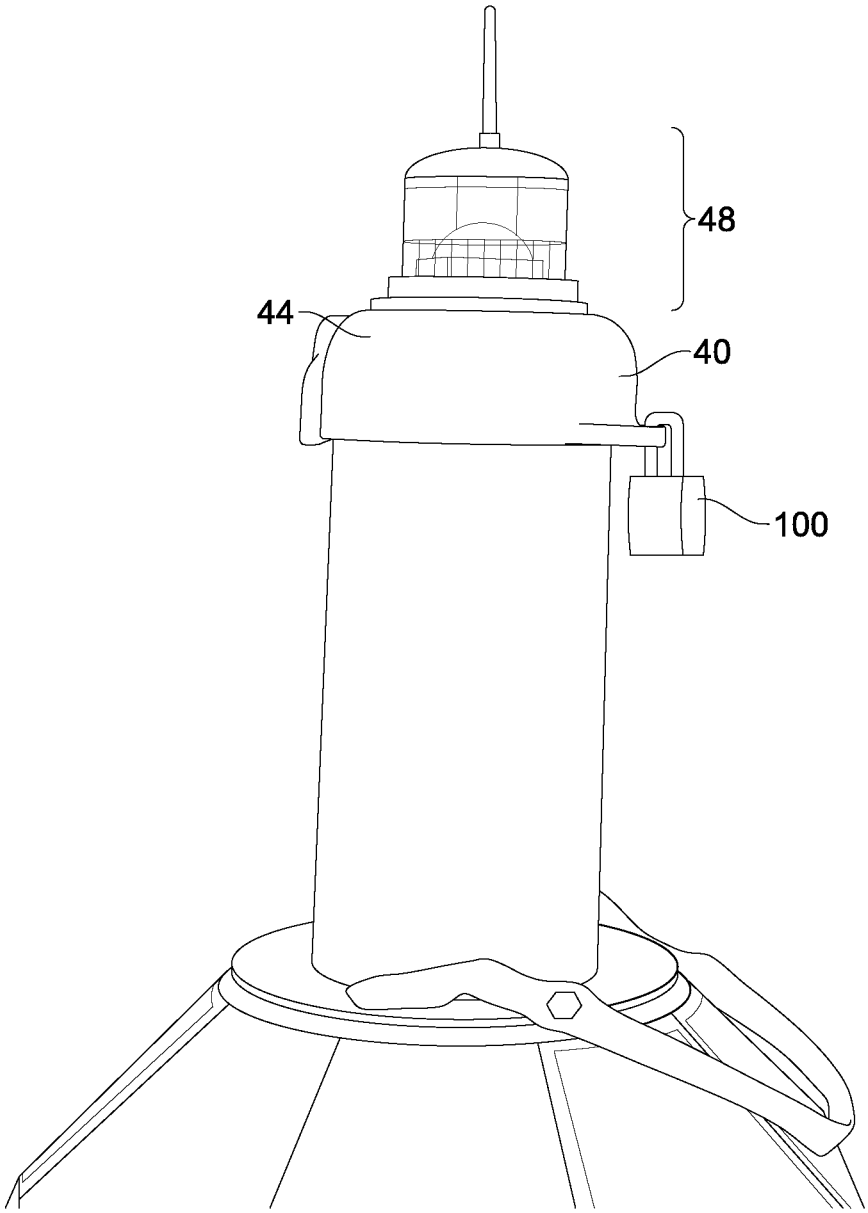

FIG. 18 is an image of a cap connected to the upper tube and a marine beacon attached to an outer surface of the cap with a lock to lockably connect the cap to the upper portion of the outer tube.

Figure 19:
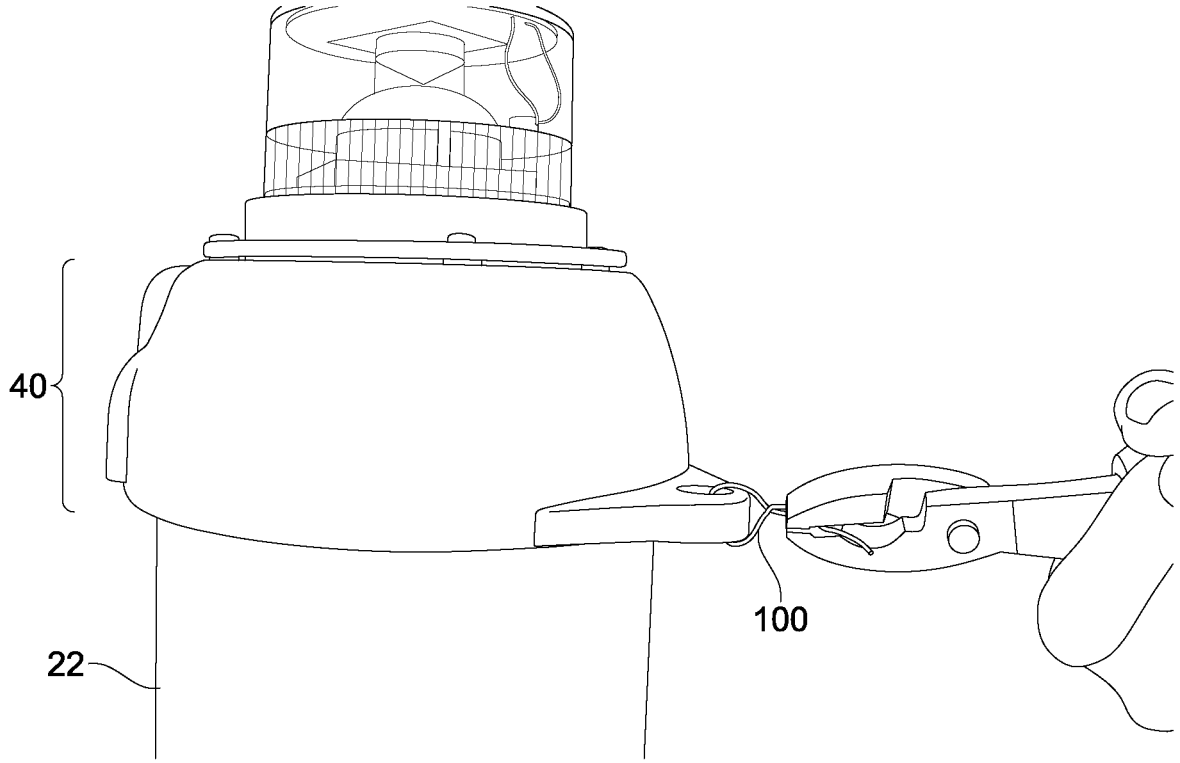

FIG. 19 is an image of a cap with a seizing wire that prevents the cap from inadvertently opening with respect to the upper portion of the outer tube.

Figure 20:
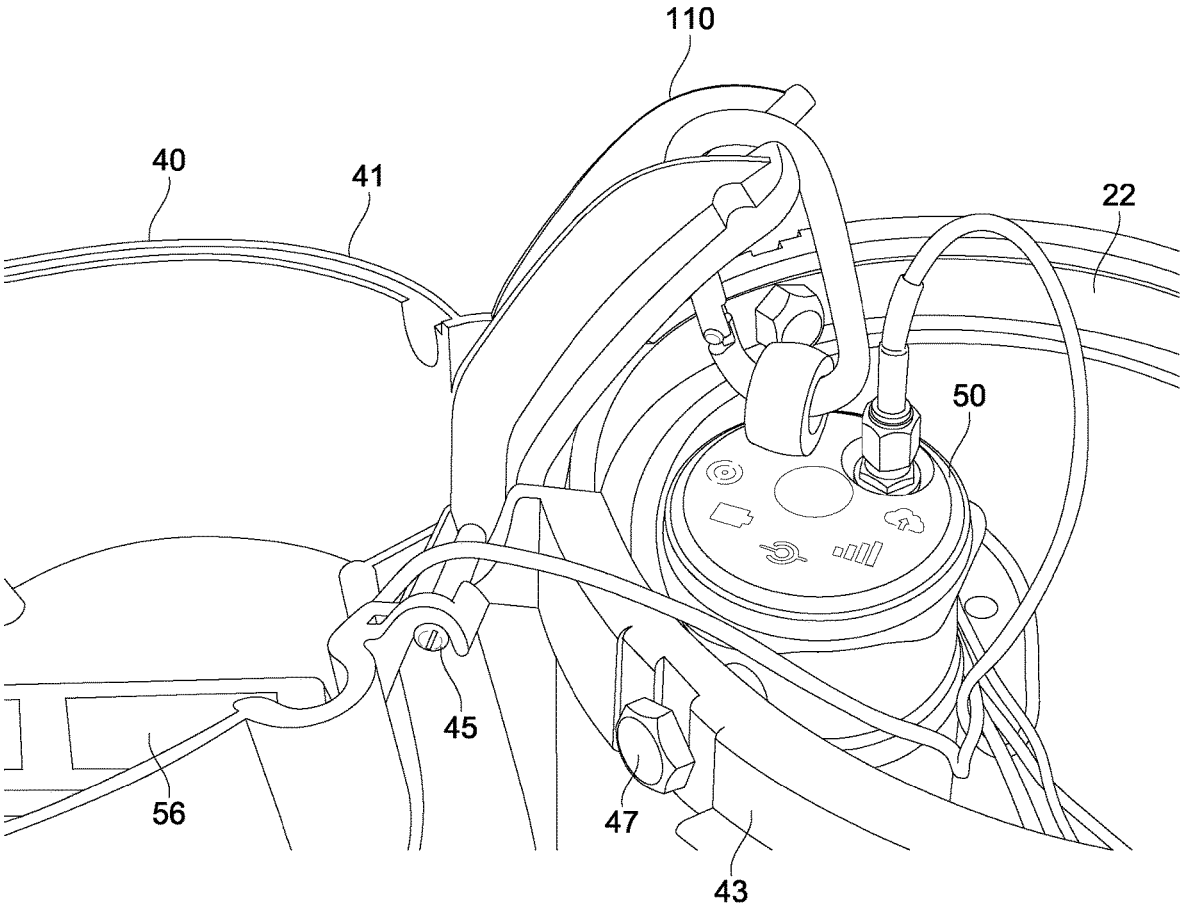

FIG. 20 is a close-up image of a cap and a telemetry device, with the telemetry device connected to the cap via a mount and a fastener.

Figure 21:
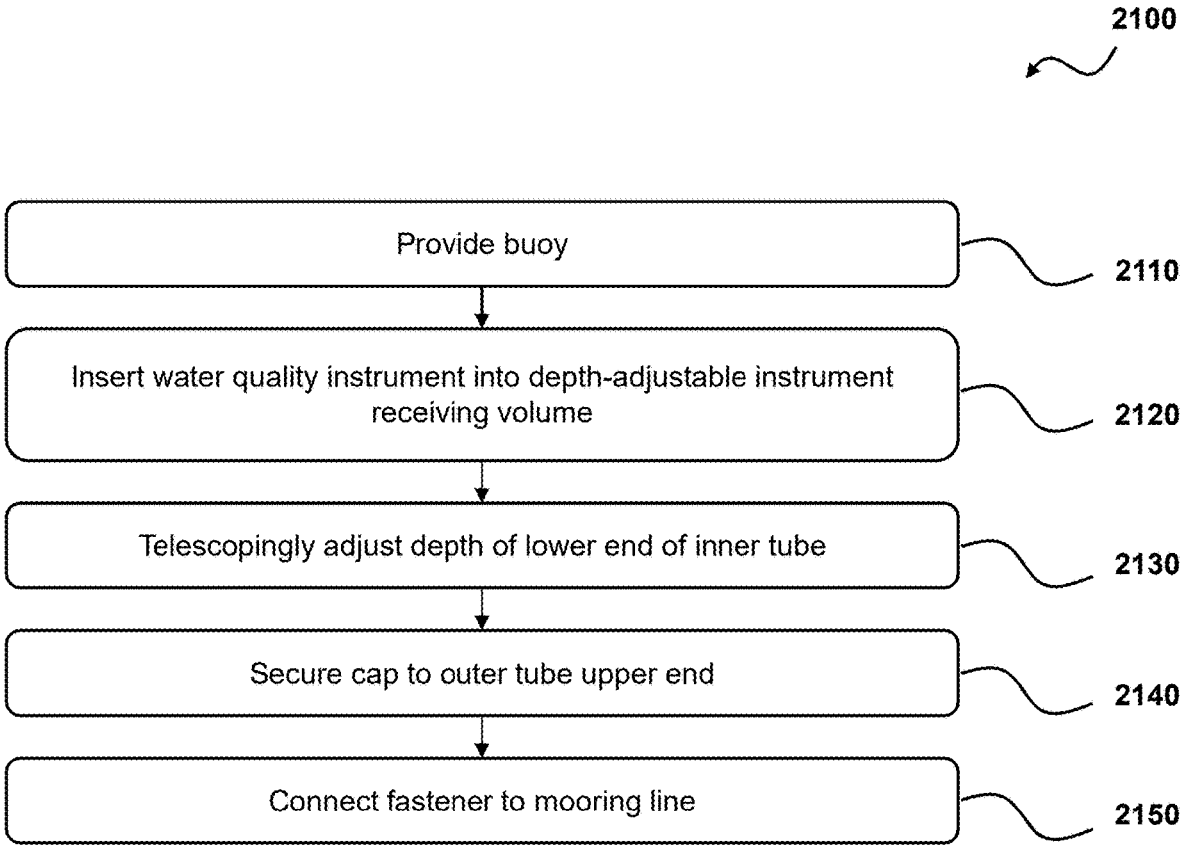

FIG. 21 is a flowchart of a method of deploying a water quality instrument to measure a water parameter according to some embodiments.

Figure 22:
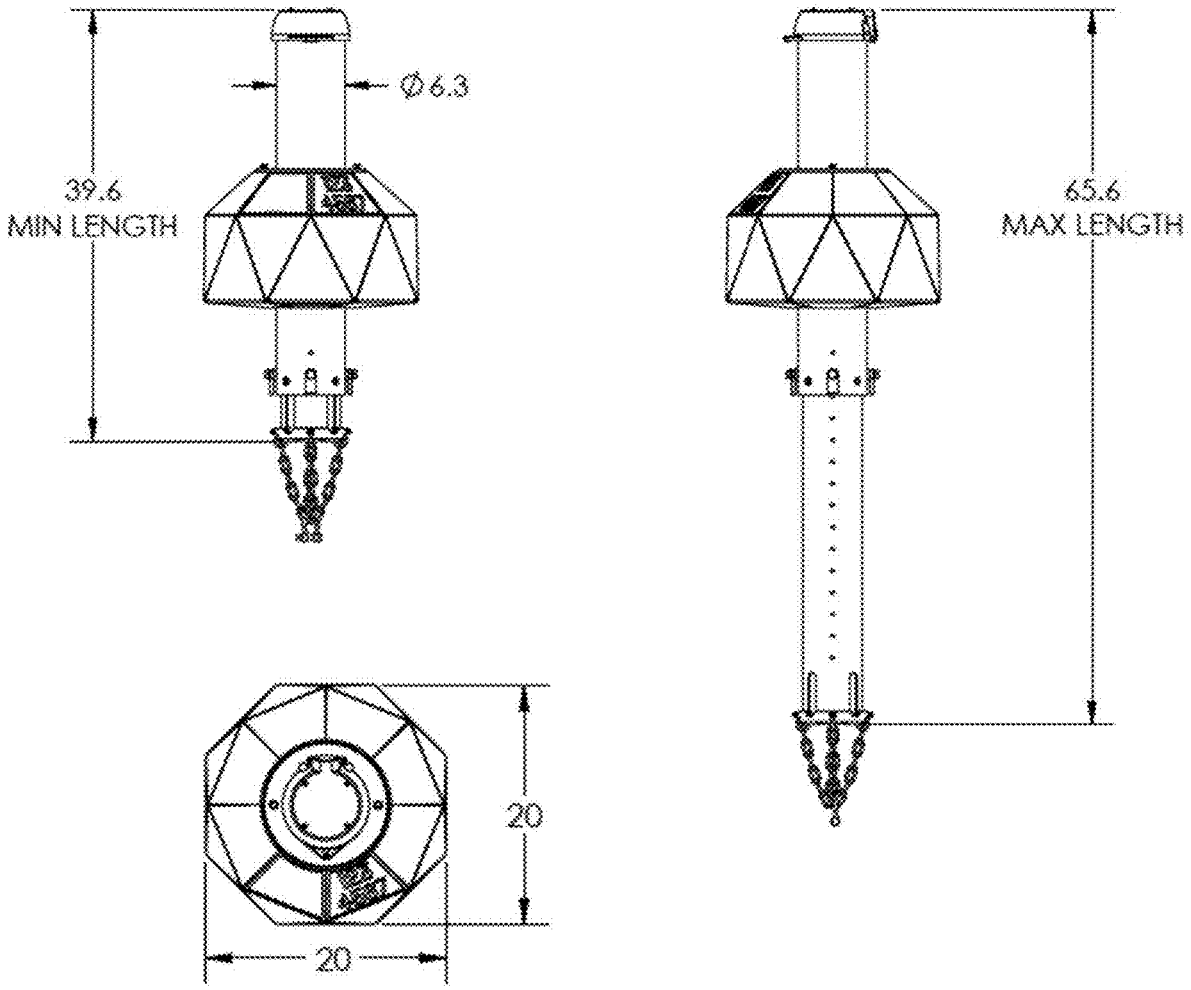

FIG. 22 illustrates some representative dimensions of a minimum length and outer tube diameter (top left panel), a maximum length (top right panel) and maximum buoy diameter (bottom left panel).

Figure 23:
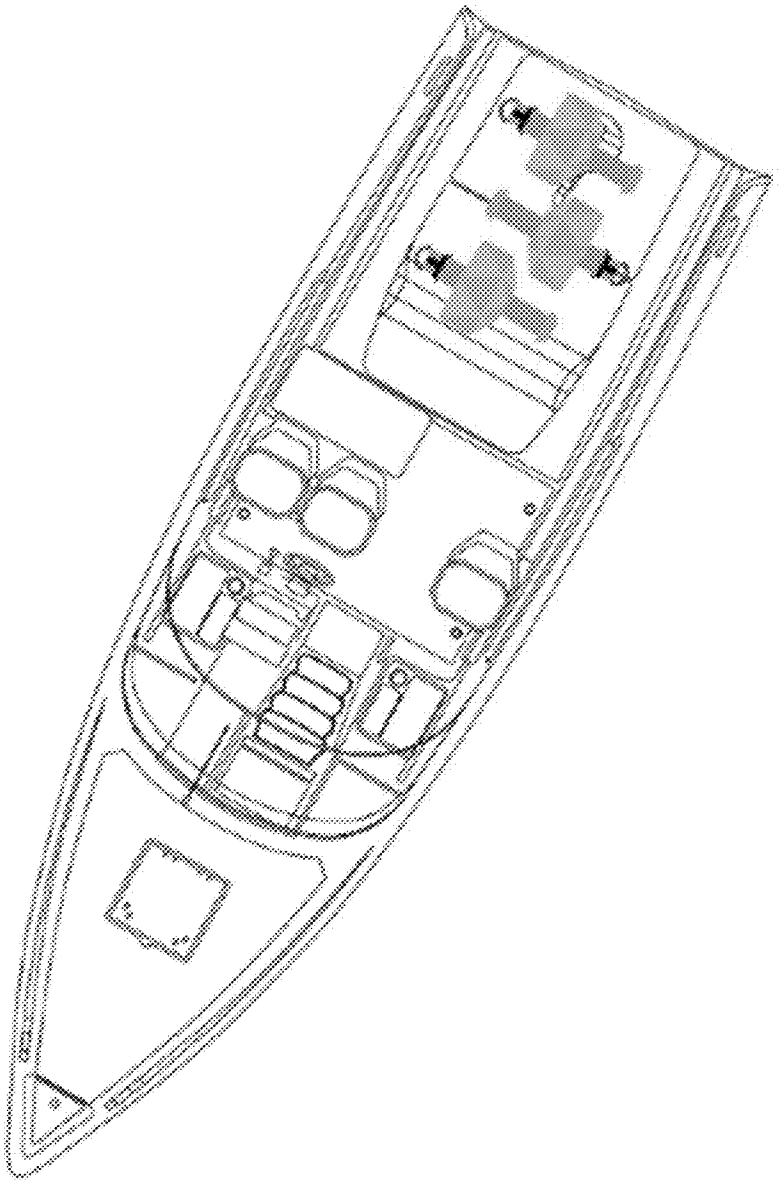

FIG. 23 illustrates the compact size and anti-rolling configurations are important for providing ease of transport, in this example for three buoys in a relatively modest size boat.

DETAILED DESCRIPTION OF THE INVENTION

In general, the terms and phrases used herein have their art-recognized meaning, which can be found by reference to standard texts, journal references and contexts known to those skilled in the art. The following definitions are provided to clarify their specific use in the context of the invention.

"Buoy" refers to a device capable of floating on or at the surface of a body of water, typically moored, attached, or otherwise connected to the floor of the body of water. In some embodiments, the buoy is connected to the floor of the body of water via a mooring line.

"Floatable support" refers to an element that can be used to support, detain, or carry another element, wherein the element is capable of floating on or at the surface of a body of water. A floatable support may support, detain, or carry the other element primarily or entirely due to the buoyant force exerted by the body of water on the floatable support.

"Floatable support shape" refers to the overall shape of a floatable support. For example, a floatable support may have a floatable support shape that is toroidal, cylindrical, spherical, spheroidal, conical, hemispherical, pyramidal, frustoconical, ovoidal, cubic, a bicone, a tapered cylinder, or any other shape that is suitable for supporting the other element.

"Central orifice" refers to a hole or opening through which something may pass, wherein the hole or opening is located at or near the center of a body. The hole or opening may continue completely through the body, or may only extend partially through the body. For example, a floatable support may have a central orifice that extends completely through the floatable support, such that an outer tube may be placed through the floatable support via the central orifice.

"Telescopingly connected" refers to a configuration of cylindrical elements, wherein one cylindrical element overlaps with another cylindrical element. For example, an outer tube telescopingly connected with an inner tube refers to the overlapping of a cylindrical element of the outer tube with a cylindrical element of the inner tube. The telescoping connecting can comprise pins and corresponding holes so that engagement of pin with a hole provides a fixed position between inner and outer depths and, therefore, a fixed deployment depth. By having a plurality of holes, the deployment depth is variable, but once selected can be fixed.

"Telescopingly adjustable" or "telescopingly adjusting" refers to the ability of a telescopingly connected element to be adjusted by another element or by a user of the telescopingly connected element, wherein the adjustment is made by adjusting the telescopingly connected element relative to its counterpart telescopingly connected element. For example, telescopingly adjusting the depth of the lower end of an inner tube to provide a user-selected instrument depth refers to the ability of the lower end of the inner tube to be adjusted by a user of the inner tube by adjusting lower end of the inner tube relative to the counterpart outer tube. This can be accomplished by any of a variety of mechanisms including, but not limited to, pins and pin-receiving holes, rotation wherein rotating the inner tube relative to an outer tube allows the lower tube to longitudinally move relative to the outer tube, and rotating the inner tube in the other direction then provides a tight-fit connection to set the desired depth.

Unless defined otherwise, "substantially" refers to a value that is within at least 20%, within at least 10%, or within at least 5% of a desired or true value. Substantially, accordingly, includes a value that matches a desired value.

"Operably connected" or "in operable connection" refers to a configuration of elements, wherein an action or reaction of one element affects another element, but in a manner that preserves each element's functionality. For example, a cap in operable connection with a telemetry device refers to the ability of the cap to hold or attached to the telemetry device without impacting the functionality of the telemetry device to communicate with other.

"Telemetry communication separation distance" refers to a distance separating one element from another element, so as to allow a telemetry device to communicate data wirelessly through the telemetry communication separation distance. For example, a telemetry communication separation distance between a cap and an outer tube upper portion separates the cap from the outer tube upper portion, allowing a telemetry device to communicate data wirelessly through the telemetry communication separation distance.

Figure 1:
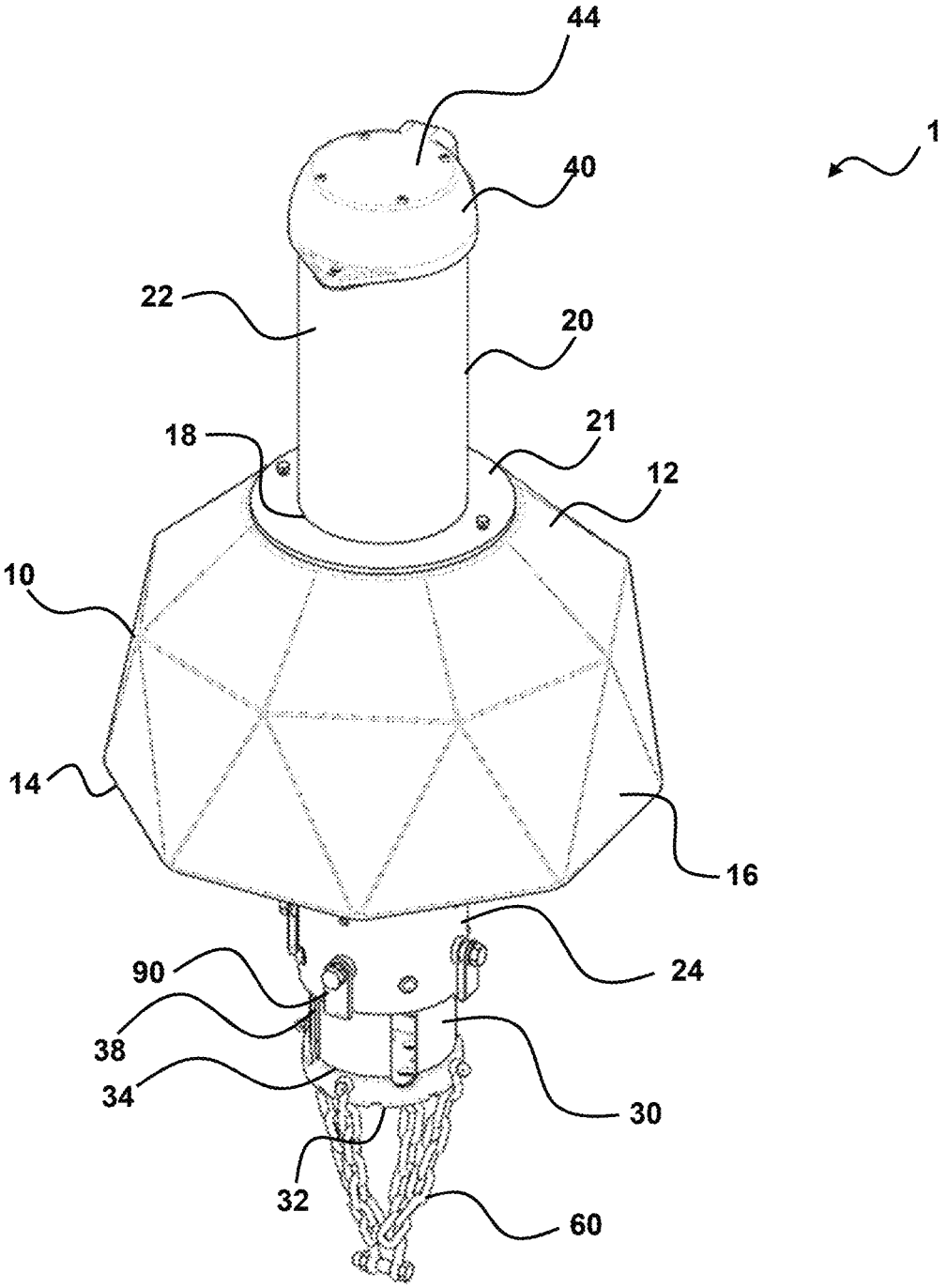
FIG. 1 is a perspective view of a buoy according to some embodiments.
Figure 2:
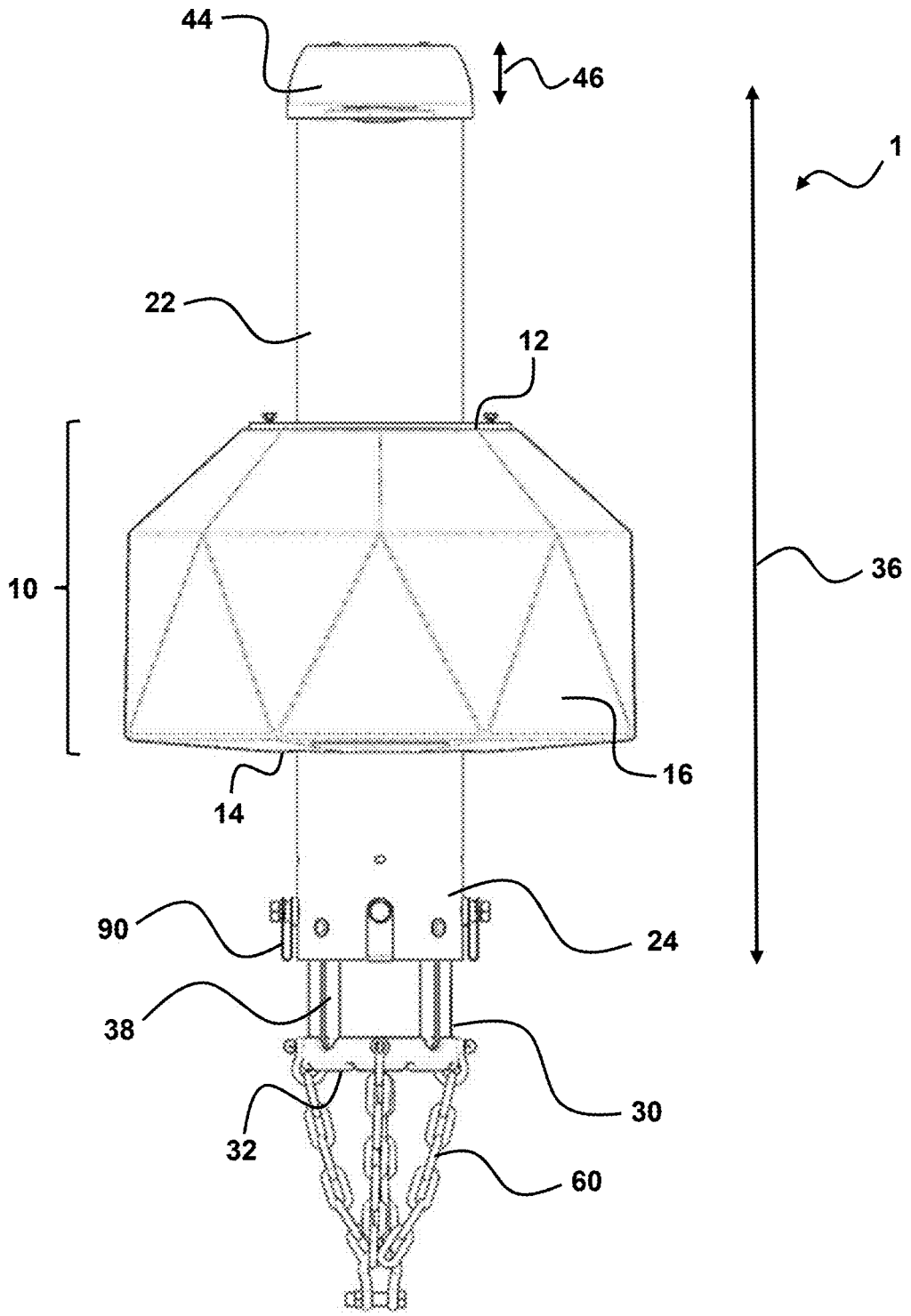
FIG. 2 is a front view of a buoy according to some embodiments.
Figure 3:
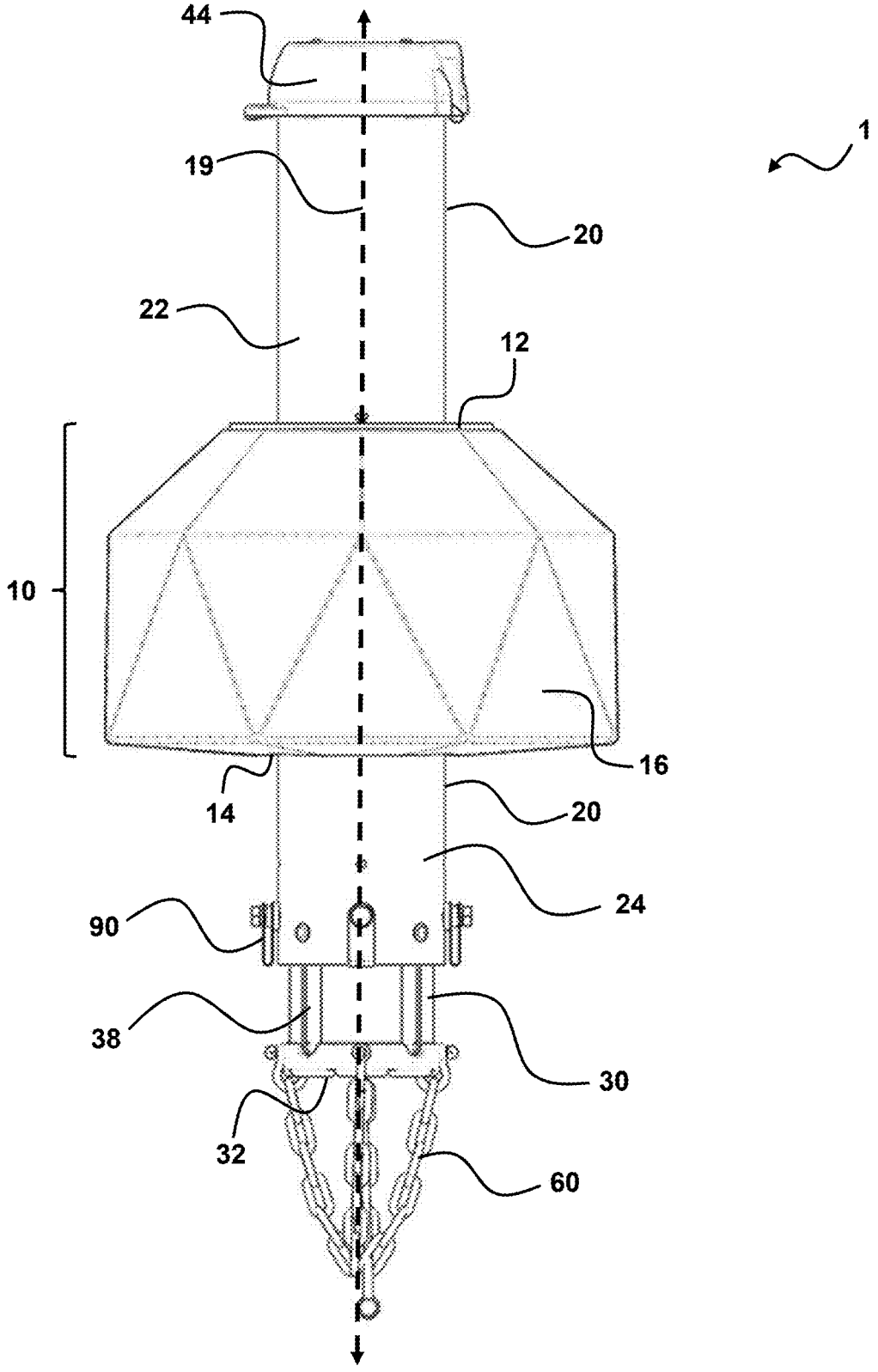
FIG. 3 is a side view of a buoy according to some embodiments.
Figure 4:
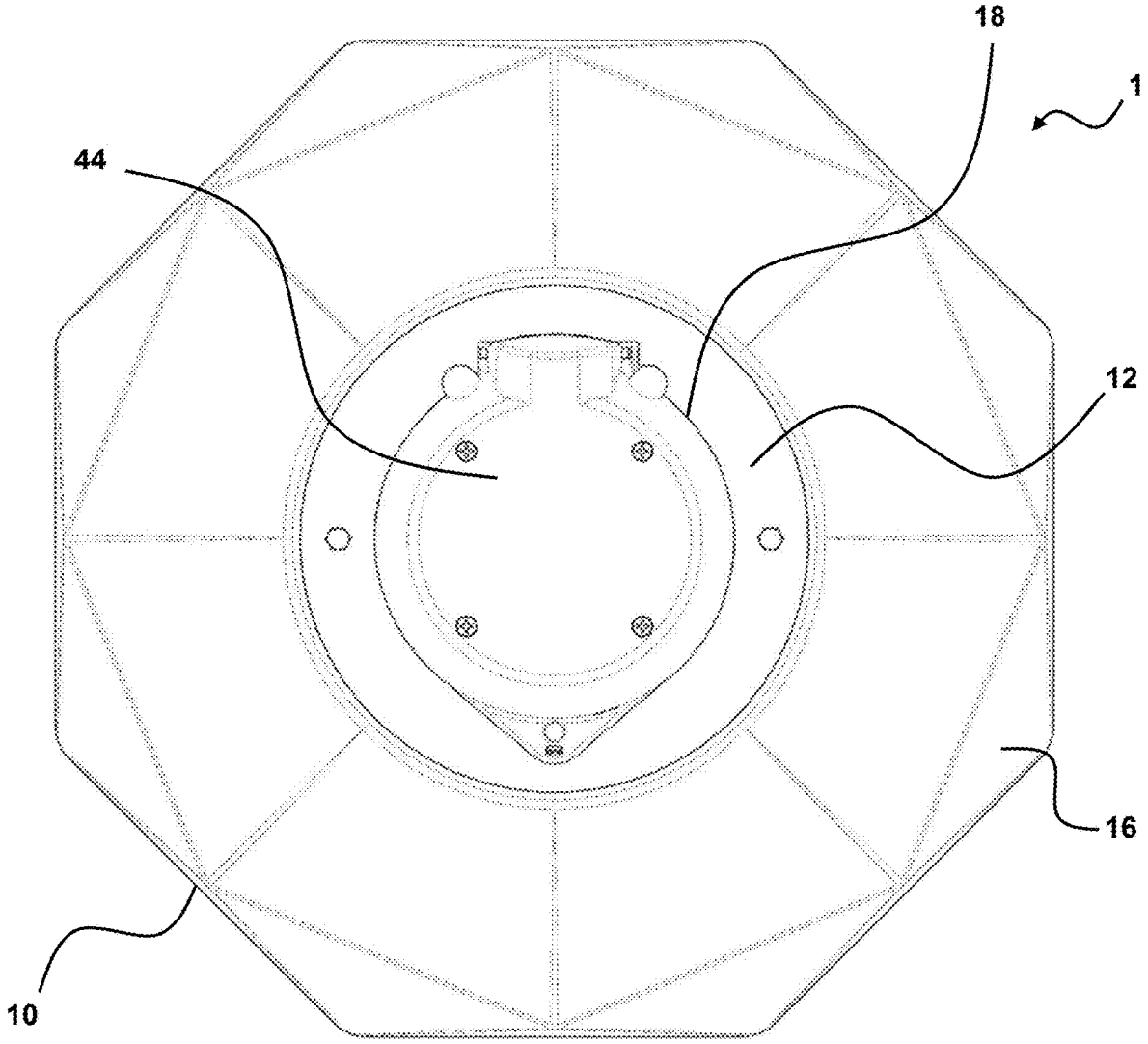
FIG. 4 is a top-down view of a buoy according to some embodiments.
Figure 5:
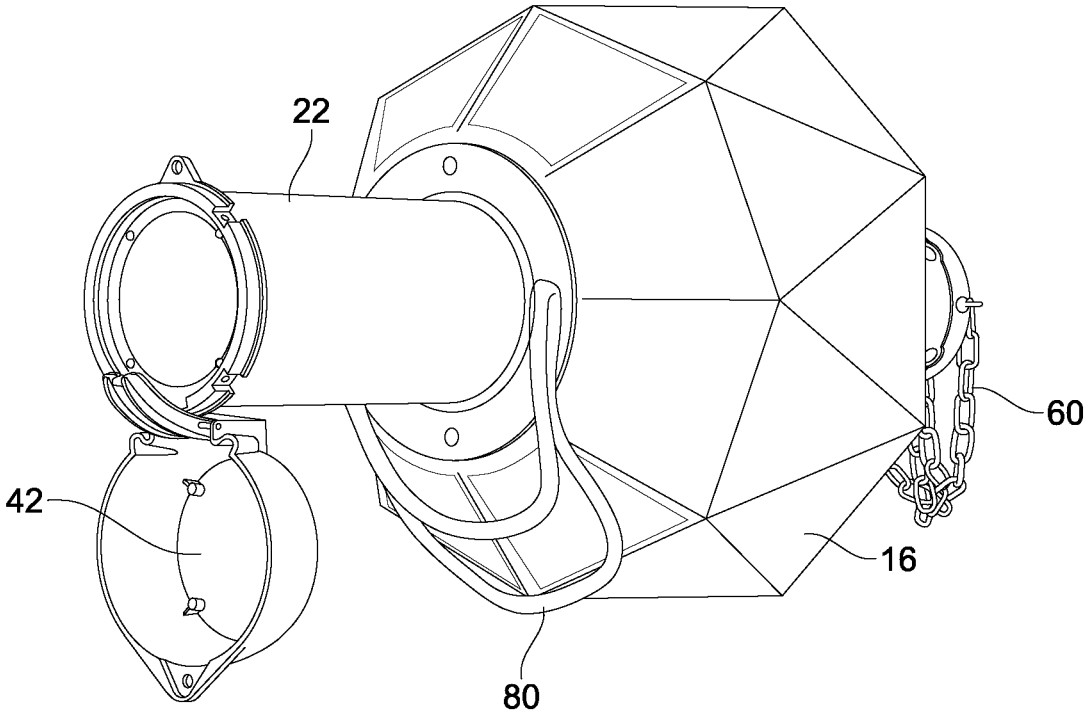
FIG. 5 is an image highlighting the top of a buoy according to some embodiments. The cap is shown in the open position and a floatable strap is attached.

"Controllably connected" or "in controllable connection" refers to a configuration of elements, wherein the connection between one element and another element can be controlled by one of the elements or by the user of one of the elements. For example, a cap in controllable connection with an upper end of an outer tube refers to the ability of the cap or of a user of the cap to control the connection between the cap and the upper end of the outer tube. The controllably connected may correspond to a hinge (FIG. 5), a fastener, or a tight-fit connection (FIG. 10) that connects the cap to the outer tube.

"Fastener" is used broadly herein to refer to a device for attaching or connecting elements. Examples include, but are not limited to, chains, ropes, threads, bolts, nails, screws, nuts, keys, washers, rivets, anchors, studs, inserts, rings, pins, grommets, clips, latches, and sockets.

"Safety stop" refers to an element that interferes with the operation of another element to prevent injury or harm to a user or device. For example, a safety stop may mechanically interfere with the movement of an inner tube telescopingly connected to an outer tube as to prevent the lower end of the inner tube from moving above the lower end of the outer tube, thereby preventing potential injury or harm to a user.

"Safety separation distance" refers to a distance separating one element from another when a safety stop is interfering with the movement of one of the elements, thereby preventing injury or harm to a user or device. For example, when a safety stop interferes with the movement of an inner tube telescopingly connected to an outer tube as to prevent the lower end of the inner tube from moving above the lower end of the outer tube, a safety separation distance is preserved between the lower end of the inner tube and the lower end of the outer tube.

"Water quality instrument" refers to an instrument capable of measuring at least one physical or chemical property of a body of water. For example, a water quality instrument may be capable of measuring a temperature, a pH, a level of dissolved oxygen, an actual conductivity, a specific conductivity, a salinity, a level of total dissolved solids, a resistivity, a density, an oxidation reduction potential, a water level, or a water pressure of the body of water. Examples of water quality instruments are disclosed in U.S. Pat. Nos. 4,461,172; 4,682,156; 4,712,505; 4,843,325; 5,337,601; 6,798,347; 6,938,506; 7,007,541; 7,138,926; 7,832,295; 9,689,855; 9,778,180; and 11,181,427; in U.S. Design Pat. Nos. D282,247; D755,655; and D803,081; and in U.S. Patent Publication Nos. 2008/0141797; 2016/0139070; 2016/0146777; 2017/0176183; 2019/0219457; and 2020/0240878; each of which is hereby incorporated by reference.

"Controllably adjustable" or "controllably adjusting" refers to the ability of an element to be adjusted by another element or by a user of the element, wherein the adjustment can be controlled by the element or by a user of the element without adversely impacting any of the elements. For example, a depth of a lower end of the inner tube being controllably adjustable relative to a floatable support refers to the ability of the depth of the inner tube being adjustable in a way that is controlled by the user of the inner tube.

"Protectably receive" or "protectably receiving" refers to the ability of an element to receive another element without harming the other element and by further protecting the other element from external harm after receiving it. For example, a depth-adjustable instrument receiving volume configured to protectably receive a water quality instrument refers to the ability of the depth-adjustable receiving volume to receive the water quality instrument without harming the water quality instrument and further protect the water quality instrument from harm after receiving the water quality instrument. The protectably receive may refer to the complete surrounding of the instrument, while allowing the free transfer of water from the surrounding environment to the water instrument.

"Lockably connected" or "in lockable connection" refers to a configuration of elements, wherein the connection between one element and another element can be locked, such that the connection cannot be broken without first performing an unlocking action. For example, a lock lockably connecting a cap to an outer tube in a locked and an unlocked configuration refers to connecting the cap to the outer tube such that the cap can be locked to the outer tube, such that the connection cannot be broken without first unlocking the cap.

Example 1: Buoy Having Adjustable Depth Deployment for a Sensor Therein

Figure 6:
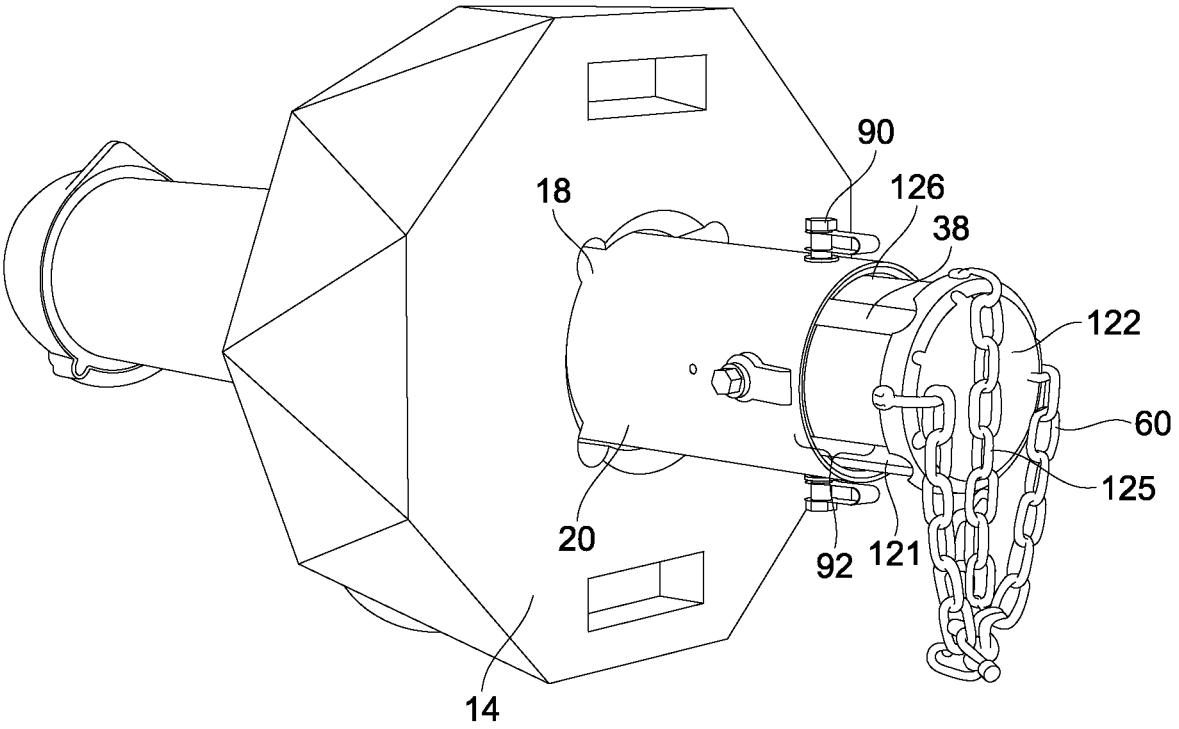
FIG. 6 is an image highlighting the bottom of a buoy according to some embodiments.
Figure 7:
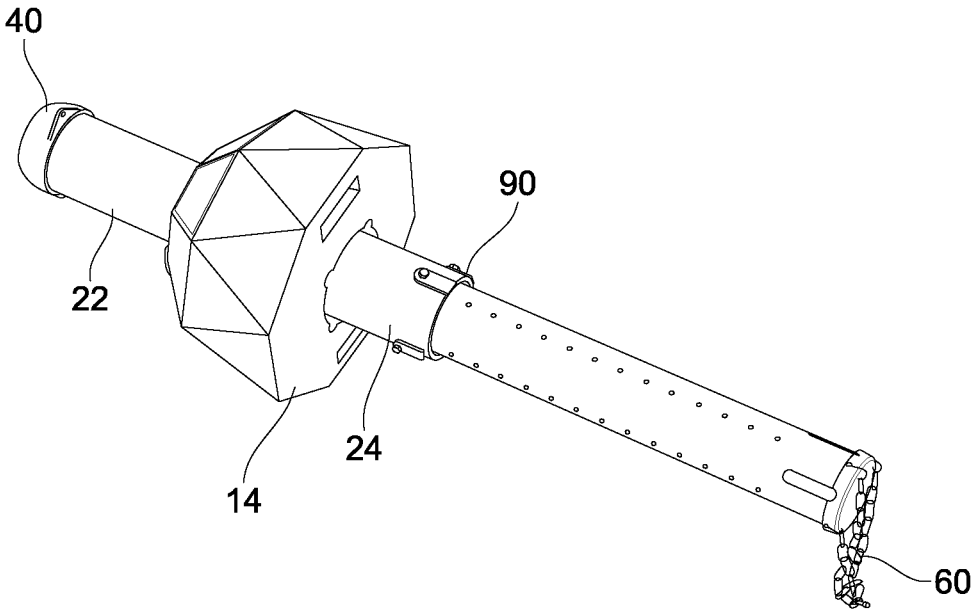
FIG. 7 is an image of a buoy according to some embodiments. The inner tube is shown in an extended position to provide a relatively deep instrument depth position.
Figure 8:
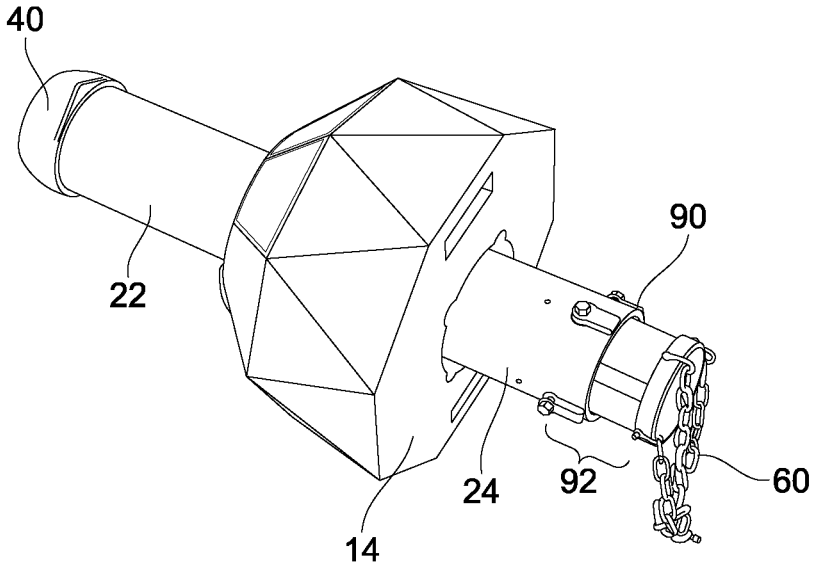
FIG. 8 is an image of a buoy according to some embodiments. The inner tube is shown in a retracted position to provide a relatively shallow instrument depth position or for shipping.
Figure 9:
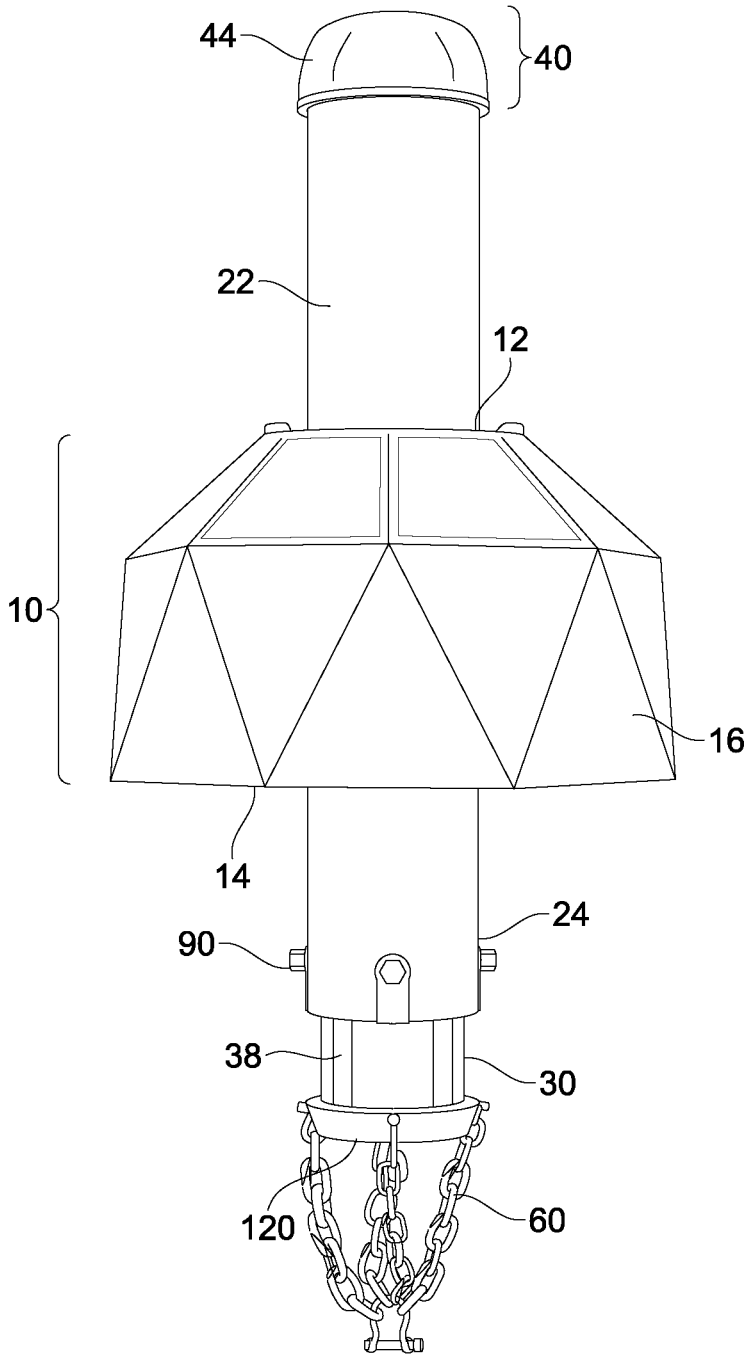
FIG. 9 is a side view image of a buoy according to some embodiments.

Various configurations of a buoy having adjustable depth deployment 1 for a sensor therein are provided in FIGS. 1-23. Referring now to FIGS. 1-4, in a most general configuration, buoy 1 comprises floatable support 10, outer tube 20, inner tube 30, cap 40, and fastener 60. Floatable support 10 has an upper surface 12 and a lower surface 14, including a flat lower surface (FIGS. 6-8). Buoy 1 can have a weight of less than 40 pounds.

Upper surface 12 is formed from a plurality of outer faces 16 and central orifice 18. At least one of the outer faces 16 has a surface shape that is flat and thereby prevents rolling of floatable support 10 around longitudinal axis 19. This is especially true when buoy 1 is yet to be deployed and is on, for example, the floor of a watercraft.

Floatable support 10 is shown having a toroidal shape. In other embodiments, floatable support 10 may have a shape that is cylindrical, spherical, spheroidal, conical, hemispherical, pyramidal, frustoconical, ovoidal, cubic, a bicone, a tapered cylinder, or any other shape suitable for supporting the other elements of buoy 1.

Floatable support 10 provides a buoyant force. In some embodiments, floatable support 10 provides at least 90 pounds of buoyant force, including a maximum buoyant force selected from a range that is between 50 pounds and 120. In some embodiments, floatable support 10 provides at least 80 pounds, at least 70 pounds, at least 60 pounds, or at least 50 pounds of buoyant force. In some embodiments, floatable support 10 provides up to 100 pounds, 110 pounds, 125 pounds, 150 pounds, or 200 pounds of buoyant force, including to support a maximum weight that is between 50 pounds and 150 pounds.

Referring now to FIG. 15, in some embodiments, floatable support 10 has a foam interior. In some embodiments, floatable support 10 comprises polyethylene and/or polyurethane. As shown here floatable support 10 has a foam interior; upper surface 12 and lower surface 14 are made of polyethylene and polyurethane.

Referring again to FIGS. 1-4, outer tube 20 is connected to floatable support 10 and is partially positioned in floatable support central orifice 18. Outer tube 20 has an upper portion 22 and a lower portion 24. Upper portion 22 extends past upper surface 12. Lower portion 24 extends past lower surface 14. The outer tube 20 can be connected to the floatable support 10 at a lip 21 the circumferentially surrounds the outer tube.

Referring again to FIG. 15, outer tube 20 may be made of aluminum, including 6061 aluminum. However, any suitable material may be used, including steel, stainless steel, other metals, polyvinyl chloride, and other plastics.

Referring again to FIGS. 1-4, inner tube 30 is telescopingly connected to outer tube 20 so that a depth of lower end 32 relative to floatable support 10 is controllably adjustable.

Referring now to FIG. 13, lower end 32 is controllably adjustable relative to floatable support 10 at a depth selected from the range of a minimum deployed depth and a maximum deployed depth any subranges thereof. Illustrated in FIG. 13 is a deployed depth range that is between about 1 foot to 3 feet (about 0.3 m and 1 m). This adjustable depth deployment is conveniently, reliably and safely achieved by the specially configured outer and inner tube that is in a telescoping connection. The safety is achieved by having passages 38 that are sized larger than a finger so that the relative motion between the inner and outer tube cannot sever a finger positioned in any of the passages 38.

Referring again to FIGS. 1-4, and inner tube 30 comprises depth-adjustable receiving volume, as reflected by arrow 36 (see, e.g., FIGS. 2 and 12). Depth-adjustable receiving volume 36 is configured to protectably receive a water quality instrument. Referring now to FIG. 12, water quality instrument 70 is shown within depth-adjustable receiving volume 36. Effectively, the volume of the depth-adjustable receiving volume is controlled by controllably positioning the depth of lower end 32 of the inner tube 30 (which is telescopingly connected to outer tube).

Referring again to FIGS. 1-4, inner tube 30 has a plurality of passages 38 traversing inner tube 30. Passages 38 are configured to provide an exchange of water between depth-adjustable receiving volume 36 and the surrounding water environment.

Referring now to FIGS. 5-9, inner tube 30 has a bottom inner surface 34. Bottom inner surface 34 is connected to instrument support layer 120 such that instrument support layer 120 forms a bottom surface (FIG. 6) of depth-adjustable instrument receiving volume 36. Instrument support layer 120 comprises an elastomer disk. As shown here, the elastomer disk is made of rubber. Water quality instrument 70 rests on instrument support layer 120 and therefore the depth of water quality instrument 70 can be reproducibly set.

Instrument support layer 120 comprises a plurality of passages 122. Passages 122 are configured to provide free flow of water between depth-adjustable instrument receiving volume 36 and the surrounding water environment.

As shown here, inner tube 30 is made of aluminum, specifically 6061 aluminum. However, any suitable material may be used, including steel, stainless steel, other metals, polyvinyl chloride, and other plastics.

With continued reference to FIGS. 5-9, outer tube 20 has a safety stop 90. Safety stop 90 is configured to provide and maintain a safety separation distance 92 between lower end 32 and lower portion 24. Safety stop 90 achieves this by mechanically interfering with the movement of inner tube 30, physically preventing lower end 32 from moving above lower portion 24. Safety separation distance 92 prevents potential injury or harm to a user of buoy 1. For example, safety stop 90 and safety separation distance 92 prevent accidental finger amputation, should a finger of the user be location within passages 38.

With continued reference to FIGS. 5-9, cap 40 has a top surface 42 and an outer surface 44. Top surface 42 is positioned above upper portion 22 and is separated from upper portion 22 by telemetry communication separation distance 46 (see, e.g., FIG. 2). Cap 40 is controllably connected to upper portion 22. Referring now to FIG. 18, cap 40 is configured to operably connect to marine beacon 48. Referring now to FIG. 12, cap 40 is configured to operably connect to telemetry device 50. When telemetry device 50 is operably connected to cap 40, a portion 54 of communication component 52 of telemetry device 50 is positioned outside upper portion 22, including antenna 56 (see, e.g., FIG. 20 illustrating antenna positioned against cap inner surface).

In some embodiments, communication component 52 may comprise an antenna 56, including a cellular antenna, a GPS antenna, or both a cellular antenna and a GPS antenna.

Referring now to FIGS. 18-19, in some embodiments, lock 100 may be located between cap 40 and upper portion 22. The lock may lockably connect cap 40 to upper portion 22 in both locked and unlocked configurations. In some embodiments, lock 100 may be a wire tie (FIG. 19). In other embodiments, the lock may be more complex requiring a key, including a digital numerical key or a mechanical key, to unlock (FIG. 18). In this manner the lock may functionally range from simply ensuring lid is maintained in a closed position to also hinder unwanted tampering or removal of valuable components within the buoy.

Referring now to FIG. 20, in some embodiments, mount 110 may be connected to cap 40 to operably connect cap 40 to telemetry device 50. When telemetry device 50 is connected to the mount and thus cap 40, and cap 40 is connected to upper portion 22, telemetry device 50 is positioned within a volume formed by upper portion 22 and cap 40.

In some embodiments, cap 40 may comprise upper cap portion 41 and lower cap portion 43. Upper cap portion 41 and lower cap portion 43 may be operably connected. In some embodiments, upper cap portion 41 is operably connected to lower cap portion 43 via a hinge 45. In some embodiments, mount 110 may be connected to upper cap portion 41 to operably connect cap 40 to telemetry device 50, such as by a connector.

Cap 40 may be connected to upper portion 22 by a connection between lower cap portion 43 and upper portion 22. In some embodiments, the connection may comprise a fastener 47. Fastener 47 may be a bolt, screw, dowel or any other appropriate fastener that reliably connects the lower cap portion to upper portion 22. The connection may be configured such that when the upper cap portion 41 is closed, upper cap portion 41 obscures and/or prevents access to fastener 47 (see FIG. 19 (illustrating the fastener is not accessible with cap closed).

When upper cap portion 41 is closed, a lock 100 may be located between upper cap portion 41 and lower cap portion 43 and/or the upper portion of the outer tube. The lock may thus lockably connect cap 40 to upper portion 22 in both locked and unlocked configurations. In some embodiments, lock 100 may be a wire tie that ensures the cap remains closed (see FIG. 19). In other embodiments, the lock may be more complex requiring a key, including a digital numerical key or a mechanical key, to unlock (see FIG. 18). In this manner the lock may functionally range from simply ensuring lid is maintained in a closed position to also hinder unwanted tampering or removal of valuable components within the buoy.

As shown here, portion 54 of communication component 52 positioned outside of upper portion 22 is attached to top surface 42.

Referring now to FIG. 18, in some embodiments, marine beacon 48 may be attached to outer surface 44.

Referring now to FIG. 11, fastener 60 is connected to lower end 32 and/or to lower portion 24. Fastener 60 is configured to connect to mooring line 62 for reliable positioning of buoy 1 during use. Fastener 60 is shown as a set of chains. However, any suitable fastener may be used, including chains, ropes, threads, bolts, nails, screws, nuts, keys, washers, rivets, anchors, studs, inserts, rings, pins, grommets, clips, latches, and sockets.

Referring now to FIG. 16, when fastener 60 is connected to mooring line 62, any tipping of the buoy is automatically corrected.

Water quality instrument 70 may measure any parameter of the water. For example, water quality instrument 70 may comprise a temperature sensor, a pH sensor, a dissolved oxygen sensor, an actual conductivity sensor, a specific conductivity sensor, a salinity sensor, a total dissolved solids sensor, a resistivity sensor, a density sensor, an oxidation reduction potential sensor, a water level sensor, a water pressure sensor, or any combination thereof.

Referring now to FIG. 6, floatable strap 80 may be attached to floatable support 10. Floatable strap 80 provides easy handling and retrieval of buoy 1.

Figure 10:
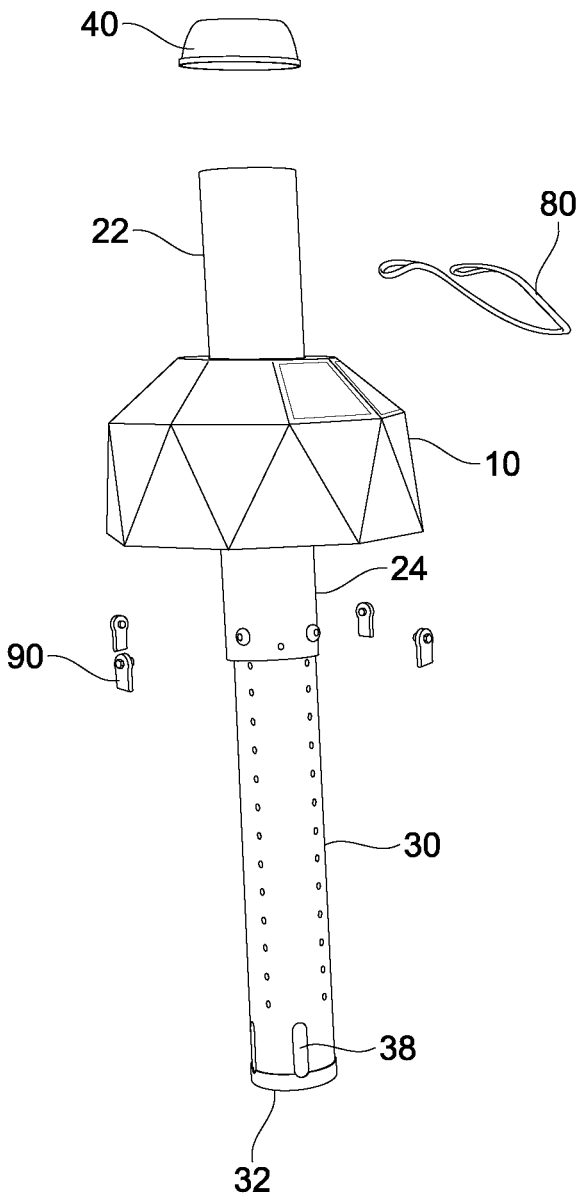
FIG. 10 is an exploded side view image of a buoy according to some embodiments. The inner tube is shown in an extended position.

Referring now to FIG. 10, various components of buoy 1 are removable from buoy 1, including safety stops 90, floatable strap 80, and cap 40.

Referring now to the cross-section cut away view of FIG. 14, in some embodiments, water quality instrument 70 and telemetry device 50, when properly installed, are located entirely within the volume formed by cap 40, outer tube 20, inner tube 30, and elastomeric disk 125. The floatable support 10 may comprise a shell 11 with a foam-filled interior 13. The foam-filled interior may have a selected size and composition to provide a desired buoyancy, depending on the application of interest, particularly the mass of the entire buoy and components, so that the deployed buoy floats on a water surface. Instrument depth is then controlled by moving the inner tube relative to the outer tube (see, e.g., FIG. 13).

Referring now to FIG. 17, in some embodiments, water quality instrument 70 is inserted into the buoy through the upper tube upper portion 22 with the lid removed. Ahead of deployment, the lid may be secured to the upper portion.

Example 2: Method of Deploying a Water Quality Instrument to Measure a Water Parameter Referring now to FIG. 21, various methods of deploying a water quality instrument to measure a water parameter are disclosed herein.

In some embodiments, method 2100 of deploying a water quality instrument to measure a water parameter comprises providing a buoy (operation 2110). In some embodiments, the buoy is one that is described in Example 1.

In some embodiments, method 2100 further comprises inserting a water quality instrument into the depth-adjustable instrument receiving volume (operation 2120). In some embodiments, operation 2120 comprises removing the cap from the upper portion of the outer tube and positioning the water quality instrument into the upper portion of the outer tube. (See, e.g., FIG. 17). In some embodiments, operation 2120 results in a lower surface of the water quality instrument resting on an elastomeric disk 125) connected to the bottom surface 126 of the inner tube at a deployed depth position (see, e.g., FIG. 6) . . . .

In some embodiments, method 2100 further comprises telescopingly adjusting the depth of the lower end of the inner tube to provide a user-selected instrument depth (operation 2130). In some embodiments, operation 2130 provides a deployed depth position that is greater than or equal to 1 foot and less than or equal to 3 feet below a water surface.

In some embodiments, method 2100 further comprises securing the cap to the outer tube upper portion (operation 2140). In some embodiment, operation 2140 comprises locking the cap so that the cap cannot be removed from the upper end portion of the outer tube.

In some embodiments, method 2100 further comprises connecting the fastener to the mooring line (operation 2150). The method may further comprise inserting telemetry device in an upper portion of the tube, such as fastened to the cap inner surface at a top end and supporting the instrument at a bottom end of the telemetry device. See, e.g., FIG. 14. The method may further comprise mounting a marine beacon to the cap (FIG. 18), so that the beacon may be visually observed from a distance.

Table Summary of Drawing Elements:

| Element No. | Element Description |
|---|---|
| 1 | Buoy |
| 10 | Floatable support |
| 12 | Upper surface (of floatable support) |
| 14 | Lower surface (of floatable support) |
| 16 | Plurality of outer faces (of floatable support) |
| 18 | Central orifice (of floatable support) |
| 19 | Longitudinal axis (of floatable support) |
| 20 | Outer tube |
| 21 | Outer tube lip |
| 22 | Upper portion (of outer tube) |
| 24 | Lower portion (of outer tube) |
| 30 | Inner tube |
| 32 | Lower end (of inner tube) |
| 34 | Bottom inner surface (of inner tube) |
| 36 | Depth-adjustable instrument receiving volume |
| 38 | Plurality of inner tube passages |
| 40 | Cap |
| 41 | Upper cap portion |
| 42 | Top surface (of cap) |
| 43 | Lower cap portion |
| 44 | Outer surface (of cap) |
| 45 | Hinge |
| 46 | Telemetry communication separation distance |
| 47 | Fastener |
| 48 | Marine beacon |
| 50 | Telemetry device |
| 52 | Communication component (of telemetry device) |
| 54 | Portion of communication component (of telemetry device) |
| 56 | Antenna (of communication component of telemetry device) |
| 60 | Fastener |
| 62 | Mooring line |
| 70 | Water quality instrument |
| 80 | Floatable strap |
| 90 | Safety stop |
| 92 | Safety separation distance |
| 100 | Lock |
| 110 | Mount (connecting cap to telemetry device) |
| 120 | Instrument support layer |
| 121 | Bottom surface of depth-adjustable instrument receiving volume |
| 122 | Passages (traversing instrument support layer) |
| 125 | Elastomeric disk |
| 126 | Bottom surface of inner tube |

Statements Regarding Incorporation by Reference and Variations

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

When a group of substituents is disclosed herein, it is understood that all individual members of that group and all subgroups, are disclosed separately. When a Markush group or other grouping is used herein, all individual members of the group and all combinations and subcombinations possible of the group are intended to be individually included in the disclosure.

Every combination of elements described or exemplified herein can be used to practice the invention, unless otherwise stated.

Whenever a range is given in the specification, for example, a size range, an angle range, a force range, a mass range, a force range, or a number range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that materials and methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A buoy comprising:

a floatable support having an upper surface and a lower surface, the upper surface formed from a plurality of outer faces and a central orifice, wherein at least one outer face has a surface shape configured to prevent rolling of the floatable support around a longitudinal axis of the floatable support;

an outer tube connected to the floatable support, wherein the outer tube is partially positioned in the central orifice, the outer tube comprising:

an upper portion extending past the floatable support upper surface; and a lower portion extending past the floatable support lower surface;

an inner tube telescopingly connected to the outer tube so that a depth of a lower end of the inner tube relative to the floatable support is controllably adjustable, wherein the inner tube comprises a depth-adjustable instrument receiving volume configured to protectably receive a water quality instrument;

a cap having a top surface positioned above the outer tube upper portion and separated from the outer tube upper portion by a telemetry communication separation distance, controllably connected to the upper portion of the outer tube, wherein the cap is configured to operably connect to a marine beacon and operably connect to a telemetry device, wherein the telemetry device operably connected to the cap has at least a portion of a communication component of the telemetry device that is positioned outside the outer tube upper portion; and a fastener connected to the lower end of the inner tube and/or the lower portion of the outer tube, wherein the fastener is configured to connect to a mooring line for reliable positioning of the buoy during use.

2. The buoy of claim 1, further comprising a floatable strap coupled to the floatable support or the outer tube.

3. The buoy of claim 1, wherein the fastener comprises a set of chains.

4. The buoy of claim 1, wherein the communication component of the telemetry device comprises an antenna.

5. The buoy of claim 4, wherein the antenna comprises: a cellular antenna, a GPS antenna, or a cellular and a GPS antenna.

6. The buoy of claim 1, wherein the floatable support has a floatable support shape that is a toroidal shape with a flat lower surface.

7. The buoy of claim 1, wherein the floatable support provides a maximum buoyant force selected from a range that is between 50 pounds and 150 pounds.

8. The buoy of claim 1, wherein the floatable support comprises a shell surface having a foam-filled interior.

9. The buoy of claim 1, wherein the floatable support comprises polyethylene and/or polyurethane.

10. The buoy of claim 1, wherein the outer tube comprises aluminum.

11. The buoy of claim 1, wherein the outer tube further comprises a safety stop configured to provide a safety separation distance between the lower end of the inner tube and the lower portion of the outer tube.

12. The buoy of claim 1, wherein the inner tube comprises aluminum.

13. The buoy of claim 1, further comprising a plurality of inner tube passages that traverse the inner tube, the plurality of inner tube passages configured to provide an exchange of water between the depth-adjustable instrument receiving volume and a surrounding water environment.

14. The buoy of claim 1, further comprising a lock between the cap and the upper portion of the outer tube to lockably connect the cap to the outer tube in a locked and an unlocked configuration.

15. The buoy of claim 1, further comprising a mount connected to the cap to operably connect the cap to the telemetry device, wherein for the cap connected to the upper portion of the outer tube the telemetry device is positioned within a volume formed by the upper portion of the outer tube and the cap.

16. The buoy of claim 1, wherein the communication component of the telemetry device that is positioned outside the outer tube upper portion is attached to an inner surface of the cap.

17. The buoy of claim 1, wherein the marine beacon is attached to an outer surface of the cap.

18. The buoy of claim 1, wherein the water quality instrument is selected from the group consisting of:

a temperature sensor;
a pH sensor;
a dissolved oxygen sensor;
an actual conductivity sensor;
a specific conductivity sensor;
a salinity sensor;
a total dissolved solids sensor;
a resistivity sensor;
a density sensor;
an oxidation reduction potential sensor;
a water level sensor; and
a water pressure sensor.

19. The buoy of claim 1, further comprising an instrument support layer connected to a bottom inner surface of the inner tube to form a bottom surface of the depth-adjustable instrument receiving volume, wherein the instrument layer comprises an elastomeric disk.

20. The buoy of claim 19, further comprising a plurality of passages that traverse the instrument support layer configured to provide free flow of water between the depth-adjustable instrument receiving volume and a surrounding water environment.

21. The buoy of claim 1, wherein the lower end of the inner tube relative to the floatable support is controllably adjustable so that the lower end of the inner tube is at a depth selected from the range of 1 foot to 3 feet below a surface of a body of water.

22. The buoy of claim 1, wherein the buoy has a weight of less than 40 pounds.

23. A method of deploying a water quality instrument to measure a water parameter, the method comprising the steps of:

providing the buoy of claim 1;
inserting a water quality instrument into the depth-adjustable instrument receiving volume;
telescopingly adjusting the depth of the lower end of the inner tube to provide a user-selected instrument depth;
securing the cap to the outer tube upper portion; and
connecting the fastener to the mooring line;

thereby deploying the water quality instrument to measure the water parameter.

24. The method of claim 23, wherein the step of inserting comprises:

opening the upper portion of the outer tube to the water quality instrument by removing the cap from the upper portion of the outer tube; and
positioning the water quality instrument into the upper portion of the outer tube, and
wherein the step of securing comprises:
locking the cap so that the cap cannot be removed from the upper end of the outer tube.

25. The method of claim 24, wherein the water quality instrument has a lower surface that rests on an elastomeric disk connected to a bottom surface of the inner tube at a deployed depth position.

26. The method of claim 25, wherein the telescopingly adjusting the depth step provides the deployed depth position that is greater than or equal to 1 foot and less than or equal to 3 feet below a water surface.

* * * * *